US011058913B2

(12) United States Patent
Dalebout et al.

(10) Patent No.: US 11,058,913 B2
(45) Date of Patent: Jul. 13, 2021

(54) INCLINABLE EXERCISE MACHINE

(71) Applicant: ICON Health & Fitness, Inc., Logan, UT (US)

(72) Inventors: William T. Dalebout, North Logan, UT (US); Gordon Cutler, Providence, UT (US); Michael L. Olson, Povidence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 79 days.

(21) Appl. No.: 16/222,035

(22) Filed: Dec. 17, 2018

(65) Prior Publication Data

US 2019/0192898 A1 Jun. 27, 2019

Related U.S. Application Data

(60) Provisional application No. 62/606,141, filed on Dec. 22, 2017, provisional application No. 62/631,211, filed on Feb. 15, 2018.

(51) Int. Cl.
*A63B 22/00* (2006.01)
*A63B 22/02* (2006.01)
(Continued)

(52) U.S. Cl.
CPC ..... *A63B 22/0023* (2013.01); *A63B 21/169* (2015.10); *A63B 22/001* (2013.01);
(Continued)

(58) Field of Classification Search
CPC ..... A63B 22/0023; A63B 22/0605; A63B 21/169; A63B 22/001; A63B 22/0664; A63B 24/0087; A63B 22/0235; A63B 24/0075; A63B 2071/0658; A63B 2220/16; A63B 2220/18; A63B 2220/89; A63B 2230/75; A63B 2209/10; A63B 2220/801;
(Continued)

(56) References Cited

U.S. PATENT DOCUMENTS 3,123,646 A 3/1964 Easton
3,579,339 A 5/1971 Chang
(Continued)

FOREIGN PATENT DOCUMENTS

CN 101005880 7/2007
CN 203169909 9/2013
(Continued)

OTHER PUBLICATIONS

International Search Report and Written Opinion issued in PCT/2018/066044 dated Apr. 11, 2019.
(Continued)

*Primary Examiner* — Nyca T Nguyen
(74) *Attorney, Agent, or Firm* — Ray Quinney & Nebeker

(57) ABSTRACT

An exercise machine may include a stationary frame, an inclinable portion movably connected to the stationary frame, and an incline mechanism connected to the stationary frame. The incline mechanism may include a coiling mechanism, a coiling rod of the coiling mechanism, a flexible coiling link movable with a rotation of the coiling rod, and where the flexible coiling link is connected to the inclinable portion.

20 Claims, 21 Drawing Sheets

(51) Int. Cl.

| | |
|---|---|
| ***A63B 24/00*** | (2006.01) |
| ***A63B 22/06*** | (2006.01) |
| ***A63B 21/16*** | (2006.01) |
| *A63B 71/06* | (2006.01) |
| *A63B 21/008* | (2006.01) |
| *A63B 21/22* | (2006.01) |
| *A63B 71/00* | (2006.01) |

(52) U.S. Cl.
CPC ..... *A63B 22/0235* (2013.01); *A63B 22/0605* (2013.01); *A63B 22/0664* (2013.01); *A63B 24/0075* (2013.01); *A63B 24/0087* (2013.01); *A63B 21/0088* (2013.01); *A63B 21/225* (2013.01); *A63B 2022/0682* (2013.01); *A63B 2071/0063* (2013.01); *A63B 2071/0658* (2013.01); *A63B 2209/10* (2013.01); *A63B 2210/50* (2013.01); *A63B 2220/16* (2013.01); *A63B 2220/18* (2013.01); *A63B 2220/801* (2013.01); *A63B 2220/803* (2013.01); *A63B 2220/806* (2013.01); *A63B 2220/89* (2013.01); *A63B 2225/093* (2013.01); *A63B 2230/06* (2013.01); *A63B 2230/75* (2013.01)

(58) Field of Classification Search
CPC ..... A63B 2230/06; A63B 2220/803; A63B 2022/0682; A63B 21/0088; A63B 21/225; A63B 2071/0063; A63B 2220/806; A63B 2225/093; A63B 2210/50; A63B 22/02–0292; A63B 69/0028–0035
See application file for complete search history.

(56) References Cited

U.S. PATENT DOCUMENTS 4,023,795 A 5/1977 Pauls
4,300,760 A 11/1981 Bobroff
4,602,779 A * 7/1986 Ogden ..... A63B 22/0023 198/846
D286,311 S 10/1986 Martinell
4,681,318 A 7/1987 Lay
4,684,126 A 8/1987 Dalebout
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet
4,850,585 A 7/1989 Dalebout
D304,849 S 11/1989 Watterson
4,880,225 A 11/1989 Lucas
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham
D307,615 S 5/1990 Bingham
4,921,242 A 5/1990 Watterson
4,932,650 A 6/1990 Bingham
D309,167 S 7/1990 Griffin
D309,485 S 7/1990 Bingham
4,938,478 A 7/1990 Lay
D310,253 S 8/1990 Bersonnet
4,955,599 A 9/1990 Bersonnet
4,971,316 A 11/1990 Dalebout
D313,055 S 12/1990 Watterson
4,974,832 A 12/1990 Dalebout
4,979,737 A 12/1990 Kock
4,981,294 A 1/1991 Dalebout
D315,765 S 3/1991 Measom
4,998,725 A 3/1991 Watterson
5,000,442 A 3/1991 Dalebout
5,000,443 A 3/1991 Dalebout
5,000,444 A 3/1991 Dalebout
D316,124 S 4/1991 Dalebout
5,013,033 A 5/1991 Watterson
5,014,980 A 5/1991 Bersonnet
5,016,871 A 5/1991 Dalebout
D318,085 S 7/1991 Jacobson
D318,086 S 7/1991 Bingham
D318,699 S 7/1991 Jacobson
5,029,801 A 7/1991 Dalebout
5,034,576 A 7/1991 Dalebout
5,058,881 A 10/1991 Measom
5,058,882 A 10/1991 Dalebout
D321,388 S 11/1991 Dalebout
5,062,626 A 11/1991 Dalebout
5,062,627 A 11/1991 Bingham
5,062,632 A 11/1991 Dalebout
5,062,633 A 11/1991 Engel
5,067,710 A 11/1991 Watterson
5,072,929 A 12/1991 Peterson
D323,009 S 1/1992 Dalebout
D323,198 S 1/1992 Dalebout
D323,199 S 1/1992 Dalebout
D323,863 S 2/1992 Watterson
5,088,729 A 2/1992 Dalebout
5,090,694 A 2/1992 Pauls
5,102,380 A 4/1992 Jacobson
5,104,120 A 4/1992 Watterson
5,108,093 A 4/1992 Watterson
D326,491 S 5/1992 Dalebout
5,122,105 A 6/1992 Engel
5,135,216 A 8/1992 Bingham
5,147,265 A 9/1992 Pauls
5,149,084 A 9/1992 Dalebout
5,149,312 A 9/1992 Croft et al.
5,171,196 A 12/1992 Lynch
D332,347 S 1/1993 Raadt
5,190,505 A 3/1993 Dalebout
5,192,255 A 3/1993 Dalebout et al.
5,195,937 A 3/1993 Engel
5,203,826 A 4/1993 Dalebout
D335,511 S 5/1993 Engel
D335,905 S 5/1993 Cutter
D336,498 S 6/1993 Engel
5,217,487 A 6/1993 Engel
D337,361 S 7/1993 Engel
D337,666 S 7/1993 Peterson
D337,799 S 7/1993 Cutter
5,226,866 A 7/1993 Engel
5,244,446 A 9/1993 Engel
5,247,853 A 9/1993 Dalebout
5,259,611 A 11/1993 Dalebout
D342,106 S 12/1993 Campbell
5,279,528 A * 1/1994 Dalebout ..... A63B 22/0023 482/54
D344,112 S 2/1994 Smith
D344,557 S 2/1994 Ashby
5,282,776 A 2/1994 Dalebout
5,295,931 A 3/1994 Dreibelbis
5,302,161 A 4/1994 Loubert
D347,251 S 5/1994 Dreibelbis
5,316,534 A 5/1994 Dalebout
D348,493 S 7/1994 Ashby
D348,494 S 7/1994 Ashby
5,328,164 A 7/1994 Soga
D349,931 S 8/1994 Bostic
5,336,142 A 8/1994 Dalebout
5,344,376 A 9/1994 Bostic
D351,202 S 10/1994 Bingham
D351,435 S 10/1994 Peterson
D351,633 S 10/1994 Bingham
D352,534 S 11/1994 Dreibelbis
D353,422 S 12/1994 Bostic
5,372,559 A 12/1994 Dalebout et al.
5,374,228 A 12/1994 Buisman
5,382,221 A 1/1995 Hsu
5,387,168 A 2/1995 Bostic
5,393,690 A 2/1995 Fu
D356,128 S 3/1995 Smith
5,409,435 A 4/1995 Daniels

(56) References Cited

U.S. PATENT DOCUMENTS 5,429,563 A 7/1995 Engel
5,431,612 A 7/1995 Holden
D360,915 S 8/1995 Bostic
5,468,205 A 11/1995 McFall
5,489,249 A 2/1996 Brewer
5,492,517 A 2/1996 Bostic
D367,689 S 3/1996 Wilkinson
5,511,740 A 4/1996 Loubert
5,512,025 A 4/1996 Dalebout et al.
D370,949 S 6/1996 Furner
D371,176 S 6/1996 Furner
5,527,245 A 6/1996 Dalebout
5,529,553 A 6/1996 Finlayson
5,540,429 A 7/1996 Dalebout
5,549,533 A 8/1996 Olson
5,554,085 A 9/1996 Dalebout
5,569,128 A 10/1996 Dalebout
5,591,105 A 1/1997 Dalebout
5,591,106 A 1/1997 Dalebout
5,595,556 A 1/1997 Dalebout et al.
5,607,375 A 3/1997 Dalebout
5,611,539 A 3/1997 Watterson
5,622,527 A 4/1997 Watterson
5,626,538 A 5/1997 Dalebout
5,626,542 A 5/1997 Dalebout
D380,024 S 6/1997 Novak
5,637,059 A 6/1997 Dalebout
D380,509 S 7/1997 Wilkinson
5,643,153 A 7/1997 Nylen
5,645,509 A 7/1997 Brewer
D384,118 S 9/1997 Deblauw
5,662,557 A 9/1997 Watterson et al.
5,669,857 A 9/1997 Watterson
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck
5,695,433 A 12/1997 Buisman
5,695,434 A 12/1997 Dalebout
5,695,435 A 12/1997 Dalebout
5,702,325 A * 12/1997 Watterson ..... A63B 22/02 482/51
5,704,879 A 1/1998 Watterson et al.
5,718,657 A 2/1998 Dalebout et al.
5,720,200 A 2/1998 Anderson
5,720,698 A 2/1998 Dalebout
D392,006 S 3/1998 Dalebout
5,722,922 A 3/1998 Watterson
5,733,228 A * 3/1998 Stevens ..... A63B 22/0023 482/51
5,733,229 A 3/1998 Dalebout
5,743,833 A 4/1998 Watterson et al.
5,762,584 A 6/1998 Daniels
5,762,587 A 6/1998 Dalebout
5,772,560 A 6/1998 Watterson et al.
5,810,698 A 9/1998 Hullett
5,827,155 A 10/1998 Jensen
5,830,114 A 11/1998 Halfen
5,833,577 A 11/1998 Hurt
5,860,893 A * 1/1999 Watterson ..... A63B 22/0023 482/51
5,860,894 A 1/1999 Dalebout et al.
5,868,648 A * 2/1999 Goody ..... A63B 22/02 482/51
5,899,834 A 5/1999 Dalebout et al.
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald
6,019,710 A 2/2000 Dalebout
6,027,429 A 2/2000 Daniels
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,193,634 B1 * 2/2001 Hurt ..... A63B 22/02 482/51
6,228,003 B1 5/2001 Hald
6,238,323 B1 5/2001 Simonson
6,251,052 B1 6/2001 Simonson
6,254,515 B1 * 7/2001 Carman ..... A63B 22/0023 482/51
6,261,022 B1 7/2001 Dalebout et al.
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris
6,422,980 B1 7/2002 Simonson
6,447,424 B1 9/2002 Ashby et al.
6,458,060 B1 10/2002 Watterson
6,458,061 B2 10/2002 Simonson
6,471,622 B1 10/2002 Hammer et al.
6,494,814 B1 * 12/2002 Wang ..... A63B 22/02 482/51
6,520,890 B2 * 2/2003 Hsu ..... A63B 22/02 482/51
6,527,674 B1 * 3/2003 Clem ..... A63B 22/0023 482/8
6,563,225 B2 5/2003 Soga
6,579,210 B1 * 6/2003 Stearns ..... A63B 22/001 482/51
6,585,624 B1 * 7/2003 Chen ..... A63B 22/0023 482/51
6,601,016 B1 7/2003 Brown
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson
6,701,271 B2 3/2004 Willner
6,702,719 B1 3/2004 Brown
6,712,740 B2 3/2004 Simonson
6,719,669 B1 * 4/2004 Wang ..... A63B 22/0023 482/54
6,730,002 B2 5/2004 Hald et al.
6,743,153 B2 6/2004 Watterson et al.
6,746,371 B1 6/2004 Brown
6,749,537 B1 6/2004 Hickman
6,749,540 B1 * 6/2004 Pasero ..... A63B 22/001 482/52
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,921,351 B1 7/2005 Hickman
6,974,404 B1 12/2005 Watterson
6,997,852 B2 2/2006 Watterson
7,025,713 B2 4/2006 Dalebout
D520,085 S 5/2006 Willardson
7,044,897 B2 5/2006 Myers

(56) References Cited

U.S. PATENT DOCUMENTS

| | | | | |
|---|---|---|---|---|
| 7,052,442 | B2 | 5/2006 | Watterson | |
| 7,060,006 | B1 | 6/2006 | Watterson | |
| 7,060,008 | B2 | 6/2006 | Watterson et al. | |
| 7,070,539 | B2 | 7/2006 | Brown | |
| 7,097,588 | B2 | 8/2006 | Watterson | |
| D527,776 | S | 9/2006 | Willardson | |
| 7,112,168 | B2 | 9/2006 | Dalebout et al. | |
| 7,128,693 | B2 | 10/2006 | Brown | |
| 7,166,062 | B1 | 1/2007 | Watterson | |
| 7,166,064 | B2 | 1/2007 | Watterson | |
| 7,169,087 | B2 | 1/2007 | Ercanbrack | |
| 7,169,093 | B2 | 1/2007 | Simonson | |
| 7,192,388 | B2 | 3/2007 | Dalebout et al. | |
| 7,250,022 | B2 | 7/2007 | Dalebout | |
| 7,282,016 | B2 | 10/2007 | Simonson | |
| 7,285,075 | B2 | 10/2007 | Cutler et al. | |
| 7,344,481 | B2 | 3/2008 | Watterson et al. | |
| 7,377,882 | B2 | 5/2008 | Watterson | |
| 7,425,188 | B2 | 9/2008 | Ercanbrack | |
| 7,429,236 | B2 | 9/2008 | Dalebout | |
| 7,455,622 | B2 | 11/2008 | Watterson | |
| 7,482,050 | B2 | 1/2009 | Olson | |
| D588,655 | S | 3/2009 | Utykanski | |
| 7,510,509 | B2 | 3/2009 | Hickman | |
| 7,537,546 | B2 | 5/2009 | Watterson | |
| 7,537,549 | B2 | 5/2009 | Nelson et al. | |
| 7,537,552 | B2 | 5/2009 | Dalebout | |
| 7,540,828 | B2 | 6/2009 | Watterson et al. | |
| 7,549,947 | B2 | 6/2009 | Hickman | |
| 7,556,590 | B2 | 7/2009 | Watterson et al. | |
| 7,563,203 | B2 | 7/2009 | Dalebout et al. | |
| 7,575,536 | B1 | 8/2009 | Hickman | |
| 7,601,105 | B1 | 10/2009 | Gipson, III | |
| 7,604,573 | B2 | 10/2009 | Dalebout | |
| D604,373 | S | 11/2009 | Dalebout | |
| 7,618,350 | B2 | 11/2009 | Dalebout | |
| 7,618,357 | B2 | 11/2009 | Dalebout | |
| 7,625,315 | B2 | 12/2009 | Hickman | |
| 7,625,321 | B2 | 12/2009 | Simonson | |
| 7,628,730 | B1 | 12/2009 | Watterson | |
| 7,628,737 | B2 | 12/2009 | Kowallis | |
| 7,637,847 | B1 | 12/2009 | Hickman | |
| 7,645,212 | B2 | 1/2010 | Ashby et al. | |
| 7,645,213 | B2 | 1/2010 | Watterson | |
| 7,658,698 | B2 | 2/2010 | Pacheco | |
| 7,674,205 | B2 | 3/2010 | Dalebout | |
| 7,713,171 | B1 | 5/2010 | Hickman | |
| 7,713,172 | B2 | 5/2010 | Watterson et al. | |
| 7,713,180 | B2 | 5/2010 | Wickens | |
| 7,717,828 | B2 | 5/2010 | Simonson | |
| 7,736,279 | B2 | 6/2010 | Dalebout | |
| 7,740,563 | B2 | 6/2010 | Dalebout | |
| 7,749,144 | B2 | 7/2010 | Hammer | |
| 7,766,797 | B2 | 8/2010 | Dalebout | |
| 7,771,329 | B2 | 8/2010 | Dalebout | |
| 7,775,940 | B2 | 8/2010 | Dalebout | |
| 7,789,800 | B1 | 9/2010 | Watterson | |
| 7,798,946 | B2 | 9/2010 | Dalebout | |
| 7,815,550 | B2 | 10/2010 | Watterson et al. | |
| 7,857,731 | B2 | 12/2010 | Hickman | |
| 7,862,475 | B2 | 1/2011 | Watterson | |
| 7,862,478 | B2 | 1/2011 | Watterson | |
| 7,862,483 | B2 | 1/2011 | Hendrickson et al. | |
| D635,207 | S | 3/2011 | Dalebout | |
| 7,901,330 | B2 | 3/2011 | Dalebout | |
| 7,909,740 | B2 | 3/2011 | Dalebout | |
| 7,980,996 | B2 | 7/2011 | Hickman | |
| 7,981,000 | B2 | 7/2011 | Watterson | |
| 7,985,164 | B2 | 7/2011 | Ashby | |
| 8,029,415 | B2 | 10/2011 | Ashby et al. | |
| 8,033,960 | B1 | 10/2011 | Dalebout | |
| D650,451 | S | 12/2011 | Olson | |
| D652,877 | S | 1/2012 | Dalebout | |
| 8,152,702 | B2 | 4/2012 | Pacheco | |
| D659,775 | S | 5/2012 | Olson | |
| D659,777 | S | 5/2012 | Watterson | |
| D660,383 | S | 5/2012 | Watterson | |
| 8,182,399 | B2 * | 5/2012 | Davis | A63B 22/02 482/54 |
| 8,192,338 | B2 * | 6/2012 | Solow | A63B 22/0007 482/142 |
| D664,613 | S | 7/2012 | Dalebout | |
| 8,251,874 | B2 | 8/2012 | Ashby | |
| 8,298,123 | B2 | 10/2012 | Hickman | |
| 8,298,125 | B2 | 10/2012 | Colledge | |
| D671,177 | S | 11/2012 | Sip | |
| D671,178 | S | 11/2012 | Sip | |
| D673,626 | S | 1/2013 | Olson | |
| 8,690,735 | B2 | 4/2014 | Watterson | |
| D707,763 | S | 6/2014 | Cutler | |
| 8,740,753 | B2 | 6/2014 | Olson | |
| 8,758,201 | B2 | 6/2014 | Ashby | |
| 8,771,153 | B2 | 7/2014 | Dalebout | |
| 8,784,270 | B2 | 7/2014 | Watterson | |
| 8,808,148 | B2 | 8/2014 | Watterson | |
| 8,814,762 | B2 | 8/2014 | Butler | |
| D712,493 | S | 9/2014 | Ercanbrack | |
| 8,840,075 | B2 | 9/2014 | Olson | |
| 8,845,493 | B2 | 9/2014 | Watterson | |
| 8,870,726 | B2 | 10/2014 | Watterson | |
| 8,876,668 | B2 | 11/2014 | Hendrickson et al. | |
| 8,894,549 | B2 | 11/2014 | Colledge | |
| 8,894,555 | B2 | 11/2014 | Olson | |
| 8,911,330 | B2 | 12/2014 | Watterson | |
| 8,920,288 | B2 | 12/2014 | Dalebout | |
| 8,986,165 | B2 | 3/2015 | Ashby | |
| 8,992,364 | B2 | 3/2015 | Law | |
| 8,992,387 | B2 | 3/2015 | Watterson | |
| D726,476 | S | 4/2015 | Ercanbrack | |
| 9,028,368 | B2 | 5/2015 | Ashby | |
| 9,028,370 | B2 | 5/2015 | Watterson | |
| 9,039,578 | B2 | 5/2015 | Dalebout | |
| D731,011 | S | 6/2015 | Buchanan | |
| 9,072,930 | B2 | 7/2015 | Ashby et al. | |
| 9,119,983 | B2 | 9/2015 | Rhea | |
| 9,123,317 | B2 | 9/2015 | Watterson | |
| 9,126,071 | B2 | 9/2015 | Smith | |
| 9,126,072 | B2 | 9/2015 | Watterson | |
| 9,138,615 | B2 * | 9/2015 | Olson | A63B 22/0023 |
| 9,142,139 | B2 | 9/2015 | Watterson | |
| 9,144,703 | B2 | 9/2015 | Dalebout | |
| 9,149,683 | B2 | 10/2015 | Watterson et al. | |
| 9,186,535 | B2 | 11/2015 | Ercanbrack | |
| 9,186,549 | B2 | 11/2015 | Watterson | |
| 9,254,409 | B2 | 2/2016 | Dalebout | |
| 9,254,416 | B2 | 2/2016 | Ashby | |
| 9,278,248 | B2 | 3/2016 | Tyger | |
| 9,278,249 | B2 | 3/2016 | Watterson | |
| 9,278,250 | B2 | 3/2016 | Buchanan | |
| 9,289,648 | B2 | 3/2016 | Watterson | |
| 9,339,691 | B2 | 5/2016 | Brammer | |
| 9,352,185 | B2 | 5/2016 | Hendrickson et al. | |
| 9,352,186 | B2 | 5/2016 | Watterson | |
| 9,375,605 | B2 | 6/2016 | Tyger | |
| 9,381,394 | B2 | 7/2016 | Mortensen | |
| 9,387,387 | B2 | 7/2016 | Dalebout | |
| 9,393,453 | B2 | 7/2016 | Watterson | |
| 9,403,047 | B2 | 8/2016 | Olson | |
| 9,403,051 | B2 | 8/2016 | Cutler | |
| 9,421,416 | B2 | 8/2016 | Mortensen | |
| 9,457,219 | B2 | 10/2016 | Smith | |
| 9,457,220 | B2 | 10/2016 | Olson | |
| 9,457,222 | B2 | 10/2016 | Dalebout | |
| 9,460,632 | B2 | 10/2016 | Watterson | |
| 9,463,356 | B2 | 10/2016 | Rhea | |
| 9,468,794 | B2 | 10/2016 | Barton | |
| 9,468,798 | B2 | 10/2016 | Dalebout | |
| 9,480,874 | B2 | 11/2016 | Cutler | |
| 9,492,704 | B2 | 11/2016 | Mortensen | |
| 9,498,668 | B2 | 11/2016 | Smith | |
| 9,517,378 | B2 | 12/2016 | Ashby et al. | |
| 9,521,901 | B2 | 12/2016 | Dalebout | |
| 9,533,187 | B2 | 1/2017 | Dalebout | |
| 9,539,461 | B2 | 1/2017 | Ercanbrack | |

(56) References Cited

U.S. PATENT DOCUMENTS 9,579,544 B2 2/2017 Watterson
9,586,086 B2 3/2017 Dalebout
9,586,090 B2 3/2017 Watterson
9,604,099 B2 3/2017 Taylor
9,616,276 B2 4/2017 Dalebout
9,616,278 B2 4/2017 Olson
9,623,281 B2 4/2017 Hendrickson
9,636,567 B2 5/2017 Brammer
9,675,839 B2 6/2017 Dalebout
9,682,307 B2 6/2017 Dalebout
9,694,234 B2 7/2017 Dalebout et al.
9,694,242 B2 7/2017 Ashby
9,737,755 B2 8/2017 Dalebout
9,757,605 B2 9/2017 Olson
9,764,186 B2 9/2017 Dalebout
9,767,785 B2 9/2017 Ashby
9,795,822 B2 10/2017 Smith
9,795,827 B2 * 10/2017 Wiener ..... A63B 22/0235
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly
9,937,377 B2 4/2018 McInelly
9,937,378 B2 4/2018 Dalebout
9,937,379 B2 4/2018 Mortensen
9,943,719 B2 4/2018 Smith
9,943,722 B2 4/2018 Dalebout
9,948,037 B2 4/2018 Ashby
9,968,816 B2 5/2018 Olson
9,968,821 B2 5/2018 Finlayson
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith
10,071,285 B2 9/2018 Smith
10,085,586 B2 10/2018 Smith
10,086,254 B2 10/2018 Watterson
10,136,842 B2 11/2018 Ashby
10,186,161 B2 1/2019 Watterson
10,188,890 B2 1/2019 Olson
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout
10,272,317 B2 4/2019 Watterson
10,279,212 B2 5/2019 Dalebout et al.
10,293,211 B2 5/2019 Watterson
D852,292 S 6/2019 Cutler
10,343,017 B2 7/2019 Jackson
10,376,736 B2 8/2019 Powell
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby
10,441,840 B2 10/2019 Dalebout
10,449,416 B2 10/2019 Dalebout
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
2001/0016542 A1 * 8/2001 Yoshimura ..... A63B 22/0292 482/54
2002/0016235 A1 2/2002 Ashby
2002/0077221 A1 6/2002 Dalebout
2002/0159253 A1 10/2002 Dalebout
2003/0045406 A1 3/2003 Stone
2003/0125165 A1 * 7/2003 Trevino ..... A63B 22/0235 482/54
2004/0091307 A1 5/2004 James
2004/0171464 A1 9/2004 Ashby
2004/0171465 A1 9/2004 Hald
2004/0204295 A1 * 10/2004 Wang ..... A63B 24/00 482/54
2004/0248713 A1 * 12/2004 Campanaro ..... A63B 23/03575 482/123
2005/0049123 A1 3/2005 Dalebout
2005/0077805 A1 4/2005 Dalebout
2005/0096189 A1 * 5/2005 Chen ..... A63B 22/0235 482/54
2005/0107229 A1 5/2005 Wickens
2005/0164839 A1 7/2005 Watterson
2005/0255969 A1 * 11/2005 Smith ..... A63B 22/0023 482/54
2005/0272577 A1 12/2005 Olson
2006/0035757 A1 * 2/2006 Flick ..... A63B 22/0235 482/54
2007/0117683 A1 5/2007 Ercanbrack
2007/0142175 A1 * 6/2007 Morgan ..... A63B 21/0622 482/1
2007/0225127 A1 * 9/2007 Pan ..... A63B 22/0207 482/54
2007/0254778 A1 11/2007 Ashby
2008/0051256 A1 2/2008 Ashby
2008/0242520 A1 10/2008 Hubbard
2008/0300110 A1 12/2008 Smith
2009/0005224 A1 * 1/2009 Davis ..... A63B 22/02 482/54
2009/0105052 A1 4/2009 Dalebout
2010/0242246 A1 9/2010 Dalebout
2011/0124466 A1 * 5/2011 Nishimura ..... A63B 22/0235 482/4
2012/0208658 A1 * 8/2012 Christgau ..... A63B 69/0097 473/435
2012/0237911 A1 9/2012 Watterson
2012/0295774 A1 11/2012 Dalebout
2013/0123073 A1 * 5/2013 Olson ..... A63B 22/0023 482/54
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson
2013/0196822 A1 8/2013 Watterson
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2014/0024499 A1 1/2014 Watterson
2014/0073970 A1 3/2014 Ashby
2014/0121071 A1 5/2014 Strom
2014/0135173 A1 5/2014 Watterson
2014/0194260 A1 * 7/2014 Campanaro ..... A63B 23/0355 482/131
2014/0274574 A1 9/2014 Shorten et al.
2014/0274579 A1 9/2014 Olson
2014/0287884 A1 9/2014 Buchanan
2014/0309085 A1 10/2014 Watterson

(56) References Cited

U.S. PATENT DOCUMENTS

| | | | | |
|---|---|---|---|---|
| 2015/0182779 | A1 | 7/2015 | Dalebout | |
| 2015/0182781 | A1 | 7/2015 | Watterson | |
| 2015/0238817 | A1 | 8/2015 | Watterson | |
| 2015/0250418 | A1 | 9/2015 | Ashby | |
| 2015/0251055 | A1 | 9/2015 | Ashby | |
| 2015/0253210 | A1 | 9/2015 | Ashby et al. | |
| 2015/0253735 | A1 | 9/2015 | Watterson | |
| 2015/0253736 | A1 | 9/2015 | Watterson | |
| 2015/0258560 | A1 | 9/2015 | Ashby | |
| 2015/0335941 | A1* | 11/2015 | Lo | A63B 22/02 482/54 |
| 2015/0352396 | A1 | 12/2015 | Dalebout | |
| 2016/0058335 | A1 | 3/2016 | Ashby | |
| 2016/0063615 | A1 | 3/2016 | Watterson | |
| 2016/0074701 | A1* | 3/2016 | Wiener | A63B 22/0235 482/54 |
| 2016/0092909 | A1 | 3/2016 | Watterson | |
| 2016/0101311 | A1 | 4/2016 | Workman | |
| 2016/0107065 | A1 | 4/2016 | Brammer | |
| 2016/0121074 | A1 | 5/2016 | Ashby | |
| 2016/0148535 | A1 | 5/2016 | Ashby | |
| 2016/0148536 | A1 | 5/2016 | Ashby | |
| 2016/0158595 | A1 | 6/2016 | Dalebout | |
| 2016/0206922 | A1 | 7/2016 | Dalebout et al. | |
| 2016/0346595 | A1 | 12/2016 | Dalebout | |
| 2017/0036053 | A1 | 2/2017 | Smith | |
| 2017/0056711 | A1 | 3/2017 | Dalebout | |
| 2017/0056715 | A1 | 3/2017 | Dalebout et al. | |
| 2017/0124912 | A1 | 5/2017 | Ashby | |
| 2017/0144014 | A1* | 5/2017 | Porteros De Luz | A63B 21/4027 |
| 2017/0193578 | A1 | 7/2017 | Watterson | |
| 2017/0266483 | A1 | 9/2017 | Dalebout et al. | |
| 2017/0266489 | A1 | 9/2017 | Douglass | |
| 2017/0266532 | A1 | 9/2017 | Watterson | |
| 2017/0266533 | A1 | 9/2017 | Dalebout | |
| 2017/0270820 | A1 | 9/2017 | Ashby | |
| 2018/0001135 | A1 | 1/2018 | Powell | |
| 2018/0036585 | A1 | 2/2018 | Powell | |
| 2018/0085630 | A1 | 3/2018 | Capell | |
| 2018/0089396 | A1 | 3/2018 | Capell | |
| 2018/0099116 | A1 | 4/2018 | Ashby | |
| 2018/0099179 | A1 | 4/2018 | Chatterton et al. | |
| 2018/0099180 | A1 | 4/2018 | Wilkinson | |
| 2018/0099205 | A1 | 4/2018 | Watterson | |
| 2018/0104533 | A1 | 4/2018 | Powell et al. | |
| 2018/0111034 | A1 | 4/2018 | Watterson | |
| 2018/0117385 | A1 | 5/2018 | Watterson et al. | |
| 2018/0117393 | A1 | 5/2018 | Ercanbrack | |
| 2018/0154205 | A1 | 6/2018 | Watterson | |
| 2018/0154207 | A1 | 6/2018 | Hochstrasser | |
| 2018/0154208 | A1 | 6/2018 | Powell et al. | |
| 2018/0154209 | A1 | 6/2018 | Watterson | |
| 2018/0200566 | A1 | 7/2018 | Weston | |
| 2019/0058370 | A1 | 2/2019 | Tinney | |
| 2019/0080624 | A1 | 3/2019 | Watterson | |
| 2019/0151698 | A1 | 5/2019 | Olson | |
| 2019/0168072 | A1 | 6/2019 | Brammer | |
| 2019/0178313 | A1 | 6/2019 | Wrobel | |
| 2019/0192952 | A1 | 6/2019 | Powell | |
| 2019/0209893 | A1 | 7/2019 | Watterson | |
| 2019/0223612 | A1 | 7/2019 | Wattereson | |
| 2019/0232112 | A1 | 8/2019 | Watterson | |
| 2019/0269958 | A1 | 9/2019 | Dalebout | |
| 2019/0269971 | A1 | 9/2019 | Capell | |
| 2019/0275366 | A1 | 9/2019 | Powell | |
| 2019/0282852 | A1 | 9/2019 | Dalebout | |
| 2019/0328079 | A1 | 10/2019 | Ashby | |
| 2019/0329091 | A1 | 10/2019 | Powell | |
| 2019/0376585 | A1 | 12/2019 | Buchanan | |
| 2020/0009417 | A1 | 1/2020 | Dalebout | |
| 2020/0016459 | A1 | 1/2020 | Smith | |
| 2020/0238130 | A1 | 7/2020 | Silcock | |
| 2020/0254295 | A1 | 8/2020 | Watterson | |
| 2020/0254309 | A1 | 8/2020 | Watterson | |
| 2020/0254311 | A1 | 8/2020 | Watterson | |

FOREIGN PATENT DOCUMENTS

| | | |
|---|---|---|
| KR | 20040087021 | 10/2004 |
| KR | 100709733 | 4/2007 |
| TW | 479529 | 3/2002 |
| TW | I593443 | 8/2017 |
| WO | 2014137221 | 9/2014 |

OTHER PUBLICATIONS

U.S. Appl. No. 13/088,007, filed Apr. 15, 2011, Scott R. Watterson.
U.S. Appl. No. 15/973,176, filed May 7, 2018, Melanie Douglass.
U.S. Appl. No. 16/879,376, filed May 22, 2019, David Hays.
U.S. Appl. No. 16/992,870, filed Aug. 15, 2019, Gaylen Ercanbrack.
U.S. Appl. No. 16/992,886, filed Aug. 15, 2019, William T. Dalebout.
U.S. Appl. No. 29/702,127, filed Sep. 16, 2019, Gordon Cutler.
U.S. Appl. No. 62/897,113, filed Sep. 9, 2019, Megan Jane Ostler.
U.S. Appl. No. 62/914,007, filed Oct. 11, 2019, Jared Willardson.
U.S. Appl. No. 62/934,291, filed Nov. 12, 2019, William T. Dalebout.
U.S. Appl. No. 62/934,297, filed Nov. 12, 2019, William T. Dalebout.
Taiwan Search Report and Office Action with English translation issued in application 107146404 dated Apr. 27, 2020.
Office Action for Taiwanese Application No. 107146404, dated Jan. 27, 2021, 9 pages.

* cited by examiner

INCLINABLE EXERCISE MACHINE

RELATED APPLICATIONS

This application claims priority to U.S. Patent Application Ser. No. 62/606,141 titled WALL MOUNTED TREADMILL, filed on Dec. 22, 2017 and U.S. Patent Application Ser. No. 62/631,211 titled INCLINABLE EXERCISE MACHINE, filed on Feb. 15, 2018, which applications are herein incorporated by reference for all that they disclose.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among other activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in U.S. Patent Publication No. 2003/0104907 issued to Mithra M. K. V. Sankrithi, et al. This reference discloses a seating and treadmill exercise device for passengers to exercise on an aircraft capable of being displaced between stowed and deployed positions. While passengers board the aircraft, the seating and treadmill exercise device may be placed in the stowed position to allow passengers to freely move about the aircraft cabin. A folding seat is attached to the underside of the treadmill track providing a seat for an airline attendant when the aircraft is taxiing and taking off or landing. While the aircraft is in route or on long distance flights, the seating and treadmill exercise device may be placed in the deployed position so that passengers are able to exercise and stretch their legs, thus enhancing passenger well-being and health and helping to prevent maladies associated with long periods of sitting such as deep vein thrombosis.

SUMMARY

In one embodiment, an exercise machine includes a stationary frame, an inclinable portion movably connected to the stationary frame, and an incline mechanism connected to the stationary frame. The incline mechanism may include a coiling mechanism, a coiling rod of the coiling mechanism, a flexible coiling link movable with a rotation of the coiling rod, and where the flexible coiling link is connected to the inclinable portion.

The stationary frame may include a wall mountable bracket.

The stationary frame may include an upright post.

The exercise machine may include a console where the console is secured to the stationary frame.

The inclinable portion may include at least one movable element that moves with respect to the inclinable portion during the performance of an exercise. Examples of movable elements include, but are not limited to tread belts, pedals, crank arms, pulleys, cables, flywheels, other types of movable elements, or combinations thereof.

The incline mechanism may include a first slot defined in and aligned with a length of the stationary frame, a second slot defined in and aligned with the length of the stationary frame, the attached region of the inclinable portion being connected to the first slot and the second slot where the attached region of the inclinable portion is movable along an incline path defined by the first slot and the second slot and where an incline angle of the inclinable portion is changed when the attached region moves along the incline path.

The exercise machine may include a fixed end of the flexible coiling link attached to the stationary frame, and a coiled end of the flexible coiling link attached to the coiling mechanism where the flexible coiling link is connected to the inclinable portion between the fixed end and the coiled end.

When the coiling mechanism rotates in a first direction, the flexible coiling link may shorten thereby lifting an attached region of the inclinable portion, and when the coiling rod is caused to rotate in a second direction, opposite of the first direction, the flexible coiling link may unwind off the coiling mechanism allowing the attached region of the inclinable portion to lower.

The inclinable portion may include a pivot mechanism where an attached region of the inclinable portion rotatably secured to the stationary frame through the pivot mechanism and a height of the pivot mechanism is adjustable by the inclined mechanism.

The exercise machine may include a far region of the inclinable portion opposite the attached region where the height of the attached region of the inclinable portion is adjustable through the incline mechanism while a height of the far region is unadjustable through the incline mechanism.

The inclinable portion may include an inclinable range through the incline mechanism between 0 degrees and 125 degrees.

The inclinable portion may include an underside of the inclinable portion and at least one support leg connected to the underside where the stationary frame and at least one support leg collectively space the underside off a support surface when the inclinable portion is in an operational orientation.

The exercise machine may include a far region of the inclinable portion that is opposite the attached region where at least one support leg is proximate the far region.

The exercise machine may include a sensor incorporated into the coiling mechanism, a processor and memory, the memory including programmed instructions, when executed, that causes the processor to determine an incline angle of the inclinable portion based on input from the sensor.

In one embodiment, an exercise machine may include a stationary frame, an inclinable portion movably connected to the stationary frame, and an incline mechanism connected to the stationary frame. The incline mechanism may include a coiling mechanism, a coiling rod of the coiling mechanism, a flexible coiling link movable with a rotation of the coiling rod, a fixed end of the flexible coiling link attached to the stationary frame, and a coiled end of the flexible coiling link attached to the coiling mechanism where when the coiling mechanism rotates in a first direction, the flexible coiling link shortens thereby lifting the attached region of the inclinable portion; when the coiling rod is caused to rotate in a second direction, opposite of the first direction, the flexible coiling link unwinds off the coiling mechanism allowing the attached region of the inclinable portion to lower; and where the inclinable portion includes an inclinable range through the incline mechanism between 0 degrees and 125 degrees.

The inclinable portion may include a pivot mechanism and an attached region of the inclinable portion rotatably secured to the stationary frame through the pivot mechanism. a height of the pivot mechanism may be adjustable by the inclined mechanism.

The exercise machine may include a far region of the inclinable portion opposite the attached region where the height of the attached region of the inclinable portion is adjustable through the incline mechanism while a height of the far region is unadjustable through the incline mechanism.

The exercise machine may include a sensor incorporated into the coiling mechanism, a processor and memory, the memory including programmed instructions, when executed, that causes the processor to determine an incline angle of the inclinable portion based on input from the sensor.

The exercise machine may include a first slot defined in and aligned with a length of the stationary frame, a second slot defined in and aligned with the length of the stationary frame, and the attached region of the inclinable portion being connected to the first slot and the second slot where the attached region of the inclinable portion is movable along an incline path defined by the first slot and the second slot and where an incline angle of the inclinable portion is changed when the attached region moves along the incline path.

In some embodiments, an exercise machine includes a stationary frame, an inclinable portion movably connected to the stationary frame, and an incline mechanism connected to the stationary frame. The incline mechanism may include a coiling mechanism, a coiling rod of the coiling mechanism, a flexible coiling link movable with a rotation of the coiling rod, a fixed end of the flexible coiling link attached to the stationary frame, a coiled end of the flexible coiling link attached to the coiling mechanism, a sensor incorporated into the coiling mechanism, a processor and memory, the memory including programmed instructions, when executed, that causes the processor to determine an incline angle of the inclinable portion based on input from the sensor. The inclinable portion may include a pivot mechanism and an attached region of the inclinable portion movably secured to the stationary frame through the pivot mechanism where a height of the pivot mechanism is adjustable by the inclined mechanism, when the coiling mechanism rotates in a first direction, the flexible coiling link shortens thereby lifting an attached region of the inclinable portion, when the coiling rod is caused to rotate in a second direction, opposite of the first direction, the flexible coiling link unwinds off the coiling mechanism allowing the attached region of the inclinable portion to lower, and where the inclinable portion includes an inclinable range through the incline mechanism between 0 degrees and 125 degrees.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length. Further, for the purposes of this disclosure, a "flexible coiling link" generally refers to a medium that can be coiled about an object as the object rotates and that can be used to lift and lower the attached region of the inclinable portion of the exercise machine. A non-exhaustive list of flexible coiling links may include, but is not limited to, may include rope, straps, cords, rope, chains, wire, cables, webbing, cloth, other types of flexible coiling link s, or combinations thereof.

Figure 1:
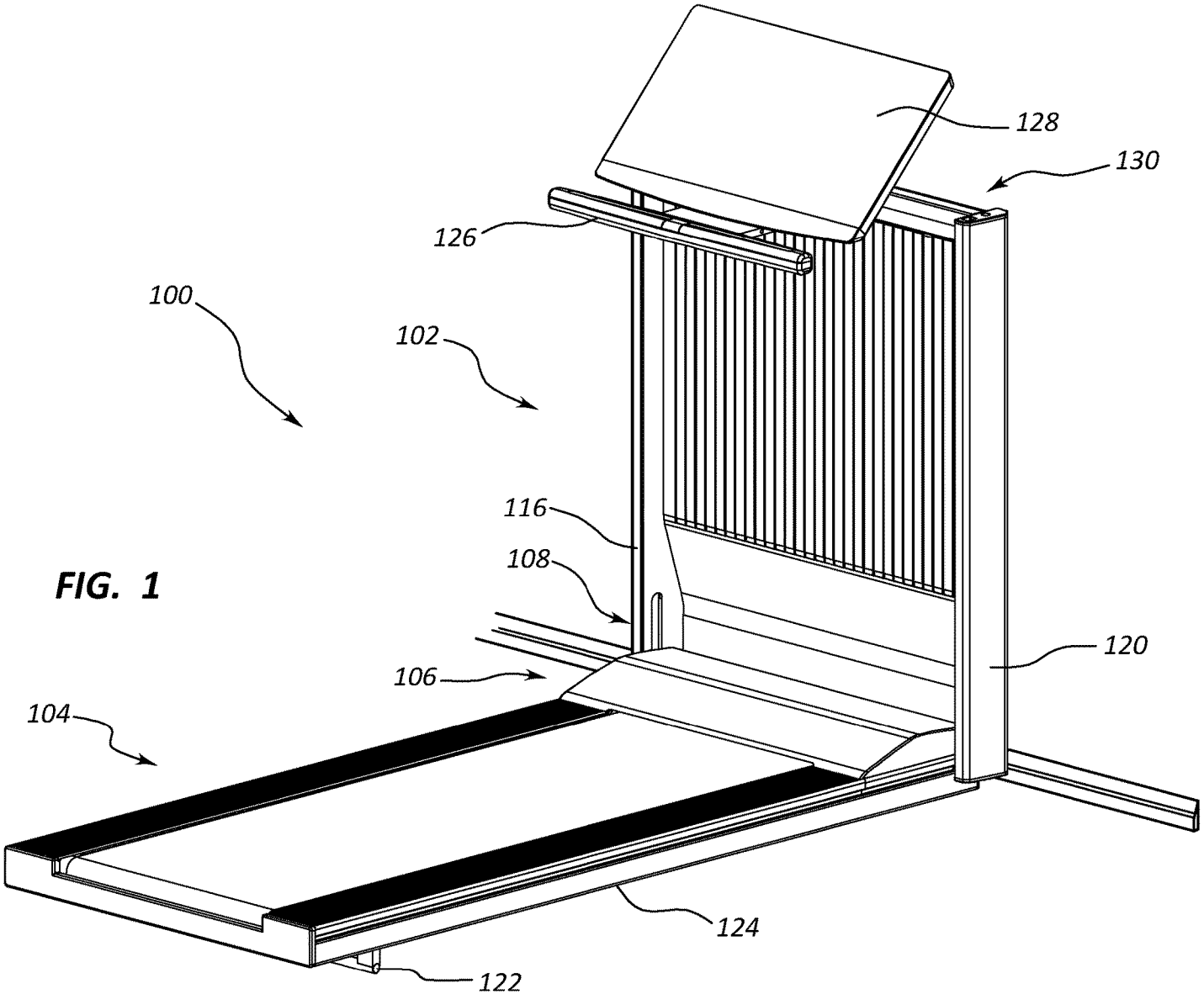
FIG. 1 depicts an example of a wall mountable apparatus in an operational orientation in accordance with aspects of the present disclosure.
Figure 2:
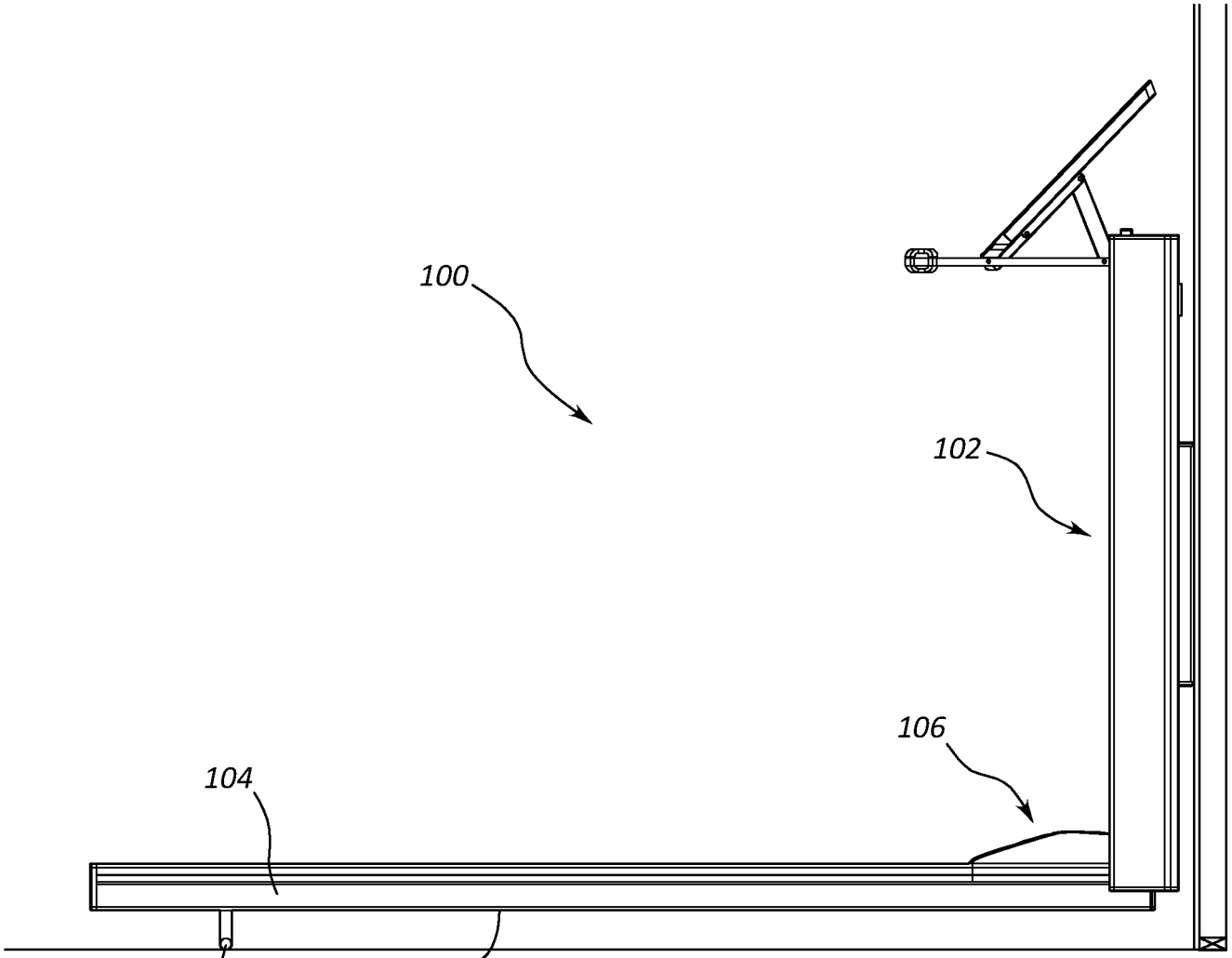
FIG. 2 depicts an example of a wall mountable apparatus in accordance with aspects of the present disclosure.

FIGS. 1 and 2 depict an example of exercise machine 100 in an operational orientation. The exercise machine 100 includes a stationary frame, which includes wall mountable bracket 102, and an inclinable portion, which includes treadmill deck 104, connected to the wall mountable bracket 102. An attached region 106 of the treadmill deck 104 is connected to a lower portion 108 of the wall mountable bracket 102. The attached region 106 of the treadmill deck 104 includes a pivot mechanism.

In this example, the pivot mechanism includes a pivot rod with a first side that is connected to a first side wall 116 of the wall mountable bracket 102 and a second side that is connected to a second side wall 120 of the wall mountable bracket 102.

The treadmill deck 104 is sized to fit within the space defined by the first side wall 116 and the second side wall 120 of the wall mountable bracket 102. The treadmill deck 104 can rotate about the pivot mechanism and nest within the space defined by the bracket 102 when the exercise machine 100 is in a storage orientation.

A support leg 122 is connected to an underside 124 of the treadmill deck 104. The support leg 122 and the wall mountable bracket 102 collectively support the weight of the treadmill deck 104. In the illustrated example, the support leg 122 is depicted connecting to the underside 124 at a far region of the treadmill deck 104, which is opposite the attached region 106. While the leg support is depicted as being connected to the far region of the treadmill deck 104, one or more support legs may be placed at any appropriate location to the treadmill deck between the deck's attached region and far region.

An arm support 126 and a display 128 are also attached to the wall mountable bracket 102. The arm support 126 and the display 128 are also configured to collapse into a storage position and fold out into an operational position. A support structure 130 may be connected to the wall mountable bracket at a first support end. The arm support 126 may be connected to a second support end of the support structure 130. The display 128 may be connected to a top side of the support structure 130. The backside of the display 128 may be propped up with a brace and an engageable bottom edge that engages the top side of the support structure 130. The display be may be moved into the storage position by disengaging the edge from the support structure and sliding the brace downward. This motion may align the display with the support structure. When in the storage position, the support structure may be pivoted upward (or downward in some embodiments) to align with the wall mountable bracket.

Figure 3:
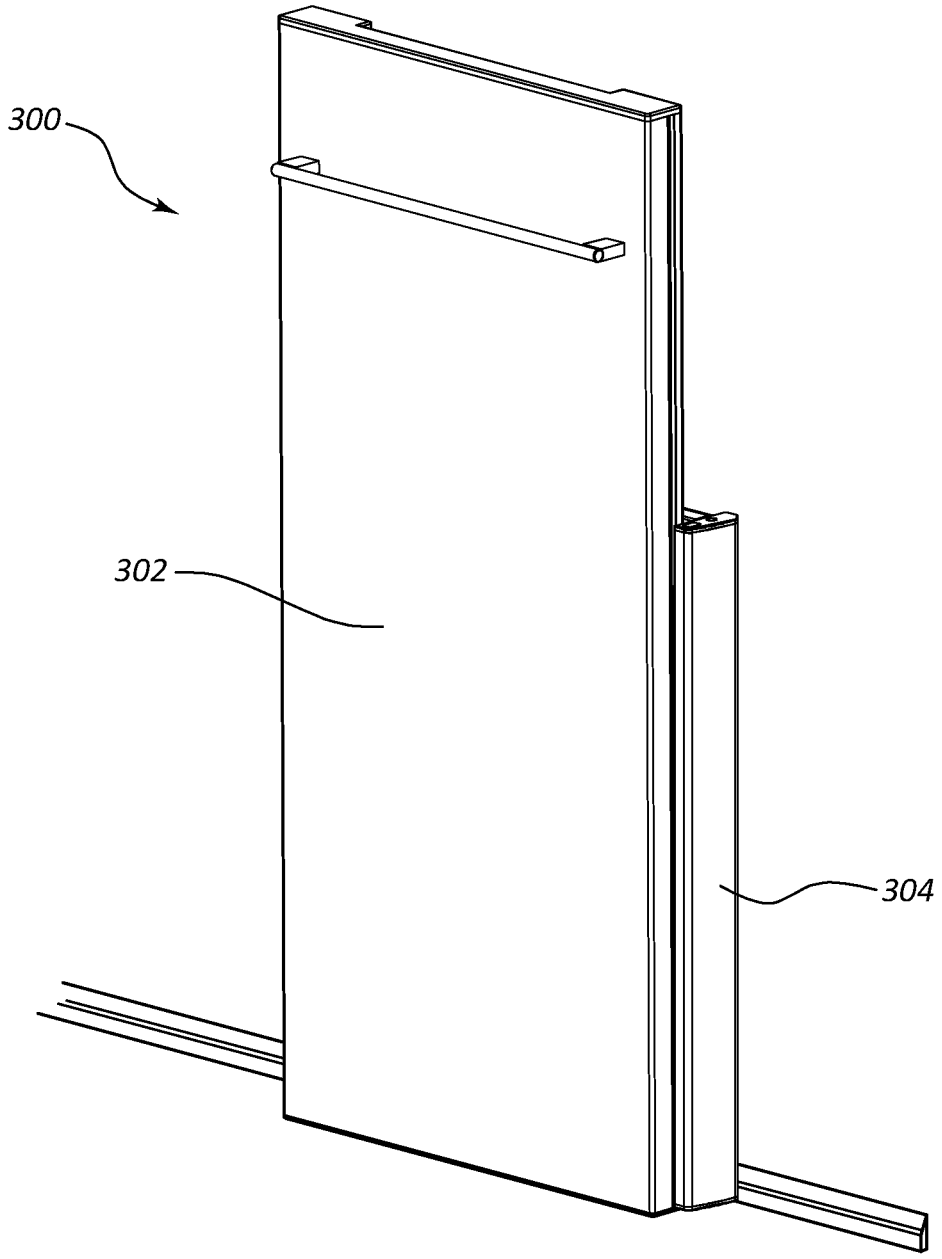
FIG. 3 depicts an example of a wall mountable apparatus in a storage orientation in accordance with aspects of the present disclosure.

FIG. 3 depicts an example of the exercise machine 300 in a storage orientation. In this example, the treadmill deck 302 is rotated upwards to be held in an upright position against the wall mountable bracket 304. A latch or another securing mechanism may hold the treadmill deck 302 up against the bracket.

Figure 4A:
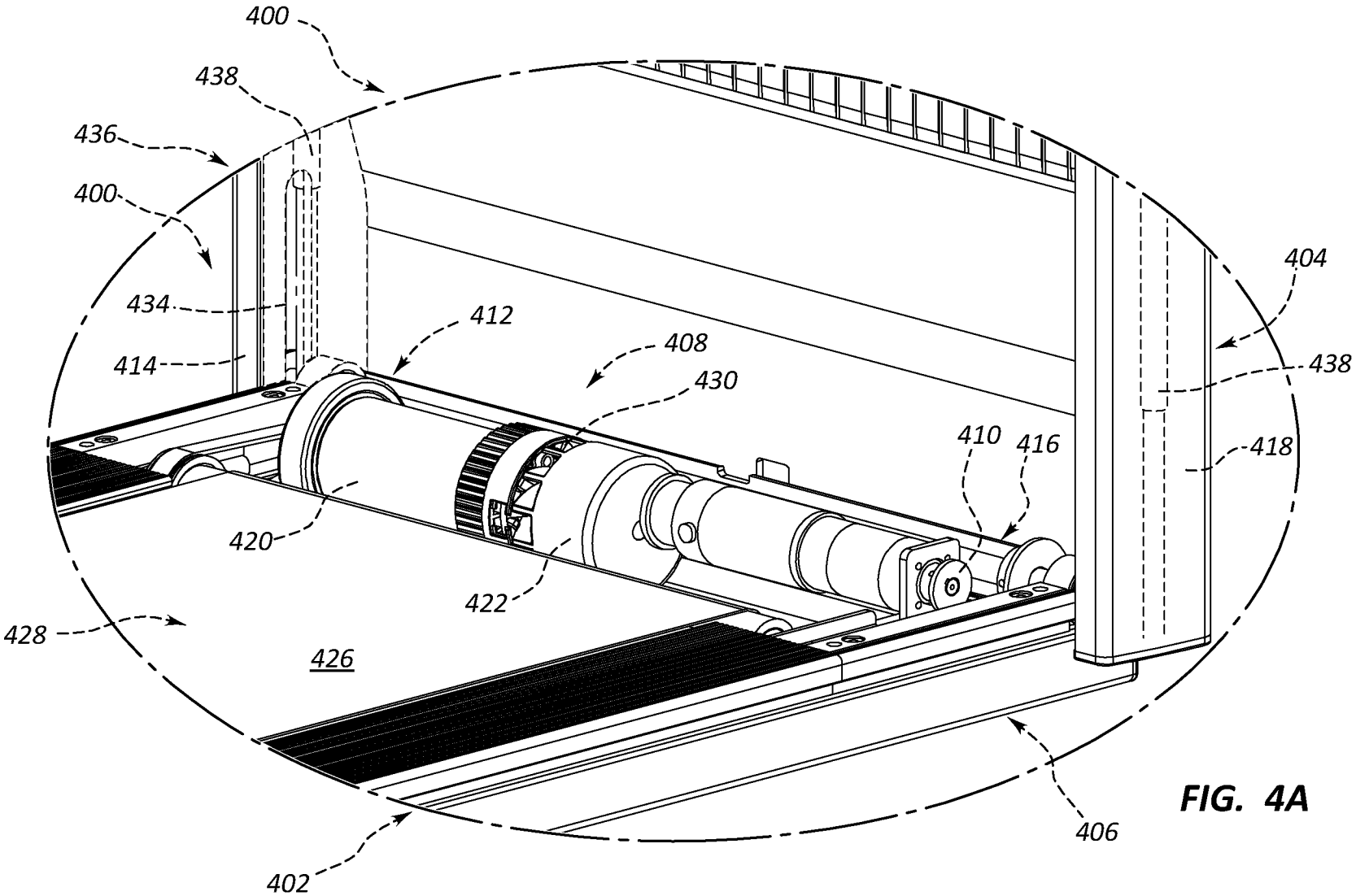
FIG. 4A depicts an example of a drive system in accordance with aspects of the present disclosure.

FIG. 4A illustrates an example of an exercise machine 400 with a treadmill deck 402 connected to a wall mountable bracket 404. In this example, an attached region 406 of the treadmill deck 402 is supported by the side walls of the wall mountable bracket 404. In this example, the pivot mechanism 408 includes a pivot rod 410 with a first side 412 that is connected to a first side wall 414 of the wall mountable bracket 404 and a second side 416 that is connected to a second side wall 418 of the wall mountable bracket 404.

In the illustrated example, a motor cover is removed for illustrative purposes. With the cover removed, a drive motor 420, a flywheel 422, and a first pulley 424 are depicted.

The treadmill deck 402 includes the first pulley 424 connected to the attached region of the treadmill deck 402, and a second pulley (not shown) connected to a far region (not shown) of the treadmill deck 402 that is opposite the attached region. A tread belt 426 surrounds the first and second pulleys.

In this example, the first pulley 424 is in mechanical communication with the drive motor 420. When the drive motor 420 is active, the drive motor 420 causes the first pulley 424 to rotate, which causes the tread belt 426 to move so that a top portion 428 of the tread belt rotates away from the wall mountable bracket 404 and a bottom portion (not shown) of the tread belt 426 rotates towards the wall mountable bracket 404. Attached to and coaxial with the drive motor 420 is the flywheel 422. The flywheel 422 rotates with the drive motor 420.

In this example, the first pulley 424 is in mechanical communication with the drive motor 420. When the drive motor 420 is active, the drive motor 420 causes the first pulley 424 to rotate, which causes the tread belt 426 to move so that a top portion 428 of the tread belt rotates away from the wall mountable bracket 404 and a bottom portion (not shown) of the tread belt 426 rotates towards the wall mountable bracket 404. Attached to and coaxial with the drive motor 420 is the flywheel 422. The flywheel 422 rotates with the drive motor 420.

A fan assembly 430 is connected to the flywheel 422 on the flywheel's side that is away from the drive motor 420. The fan assembly 430 is also coaxial with the drive motor 420. The fan assembly 430 may cool the components located within the cavity covered by the cover when the treadmill deck 402 is being operated.

The treadmill deck 402 may also be inclined so that the attached region of the deck is at a higher elevation than the far region. In this example, an incline mechanism 432 includes a first slot 434 incorporated into the first side wall 414 and a second slot (not shown) incorporated into the inside of the second side wall 418. The first and second slots may be aligned with one another to define an incline path that the attached region of the treadmill deck 402 may follow when the attached region of the treadmill deck 402 is moved upwards to form an incline angle.

In the illustrated example, the attached region of the treadmill deck is supported by a shock 436. In some examples, a first shock is connected to a first side of the deck's attached region and a second shock is connected to a second side of the deck's attached region. The shock may be any appropriate shock absorbing device. In the illustrated example, the shock 436 is a gas spring 438 that includes telescoping pair of rods. In some examples, the shocks are connected to the pivot rod or other type of pivot mechanism.

Figure 4B:
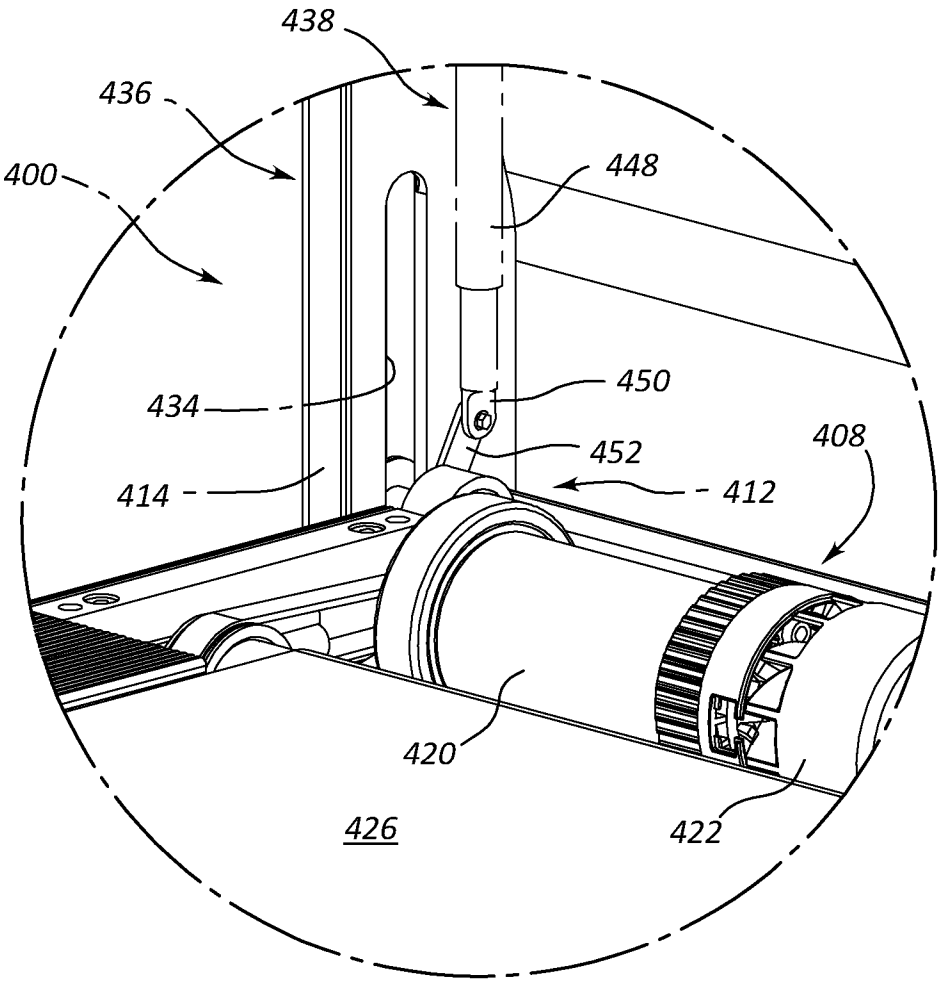
FIG. 4B depicts an example of a drive system in accordance with aspects of the present disclosure.

FIG. 4B illustrates an example of the shock 436 connected to the outside of the first side wall 414. In this example, the shock 436 includes a cylinder 448 and a movable piston 450 that is connected to a mounting arm 452. The mounting arm 452 is connected directly to the pivot rod 410. In alternative examples, the mounting arm 452 can be connected to another portion of the treadmill deck 402. Also, in alternative examples, the mounting arm 452 can be connected to any appropriate component of the treadmill deck 402.

Figure 5:
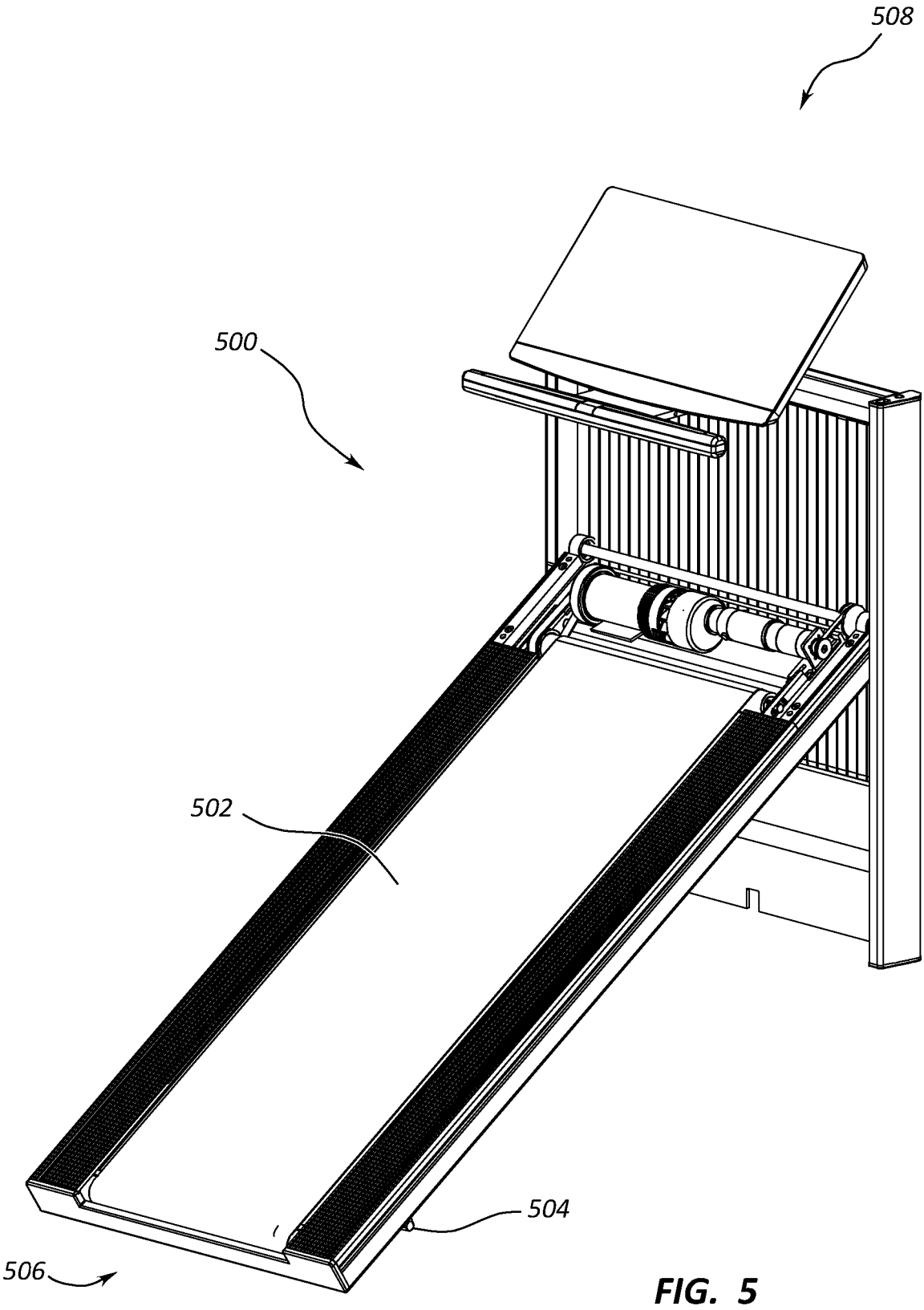
FIG. 5 depicts an example of a wall mountable apparatus in accordance with aspects of the present disclosure.

FIG. 5 depicts an example of a treadmill deck 500 of the exercise machine 502 where the treadmill deck 500 forms an incline angle. In this example, the support leg 504 is moved forward along the support surface upon which the far region 506 of the treadmill deck 500 rests. The weight of the attached region of the treadmill deck 500 is supported by the wall mountable bracket 508, which is located off the support surface.

Figure 6:
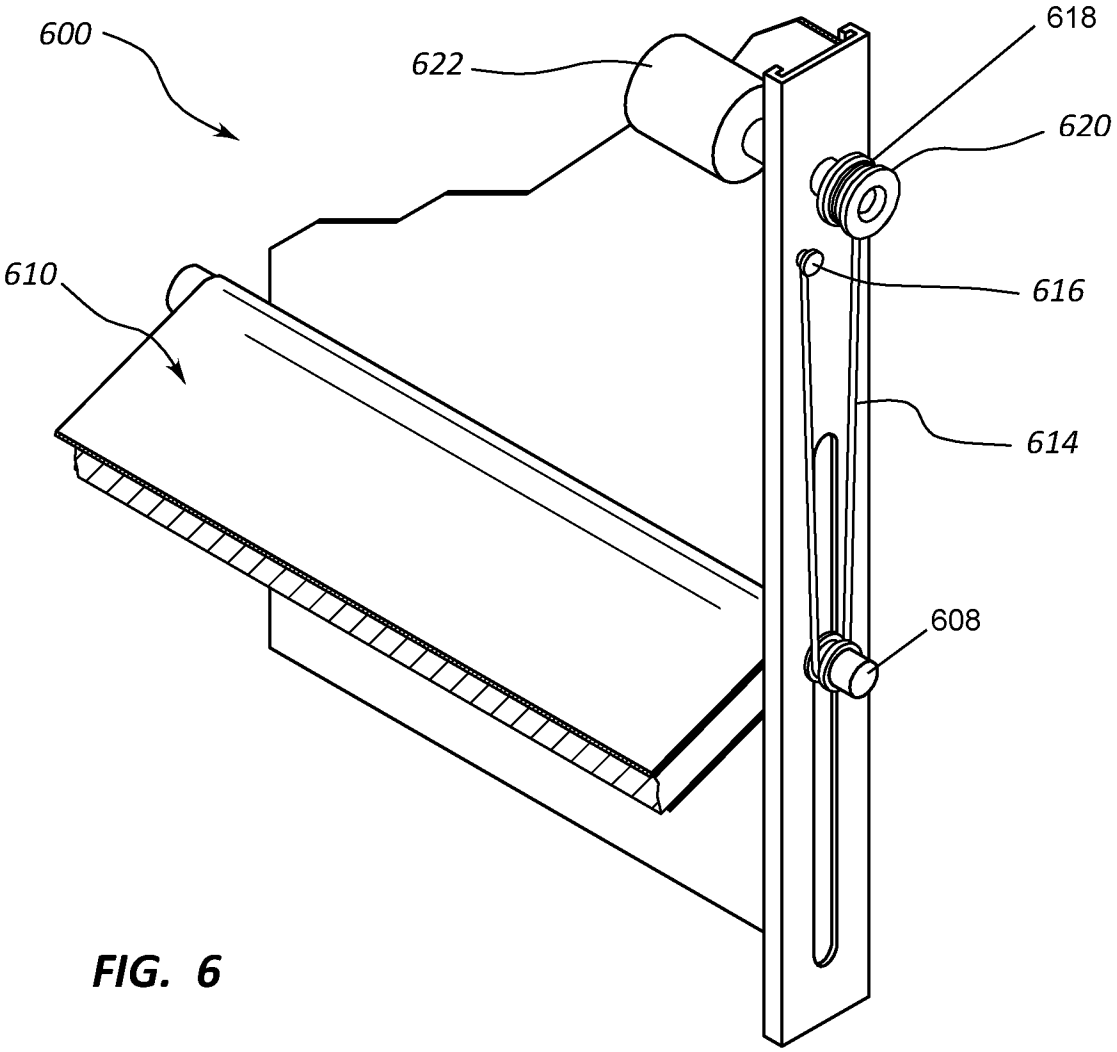
FIG. 6 depicts an example of an incline mechanism in accordance with aspects of the present disclosure.

FIG. 6 depicts an example of an incline mechanism 600. In this example, the incline mechanism 600 is incorporated into the first side wall and the second side wall of the wall mountable bracket. The pivot rod supports the attached region 610 of the treadmill deck, and a strap 614 supports the pivot rod 608. A fixed side 616 of the strap 614 is rigidly connected to the wall mountable bracket, and a coil side 618 of the strap 614 is connected to the coiling rod 620 of a coiling mechanism 622. In this example, the coiling mechanism includes a motor that causes the coiling rod 620 to rotate. As the motor rotates in a first direction, the strap 614 shortens lifting the deck's attached region. When the coiling rod 620 is caused to rotate in a second direction, which is opposite the first direction, the strap 614 unwinds off the coiling rod 620 allowing the deck's attached region to lower.

Figure 7:
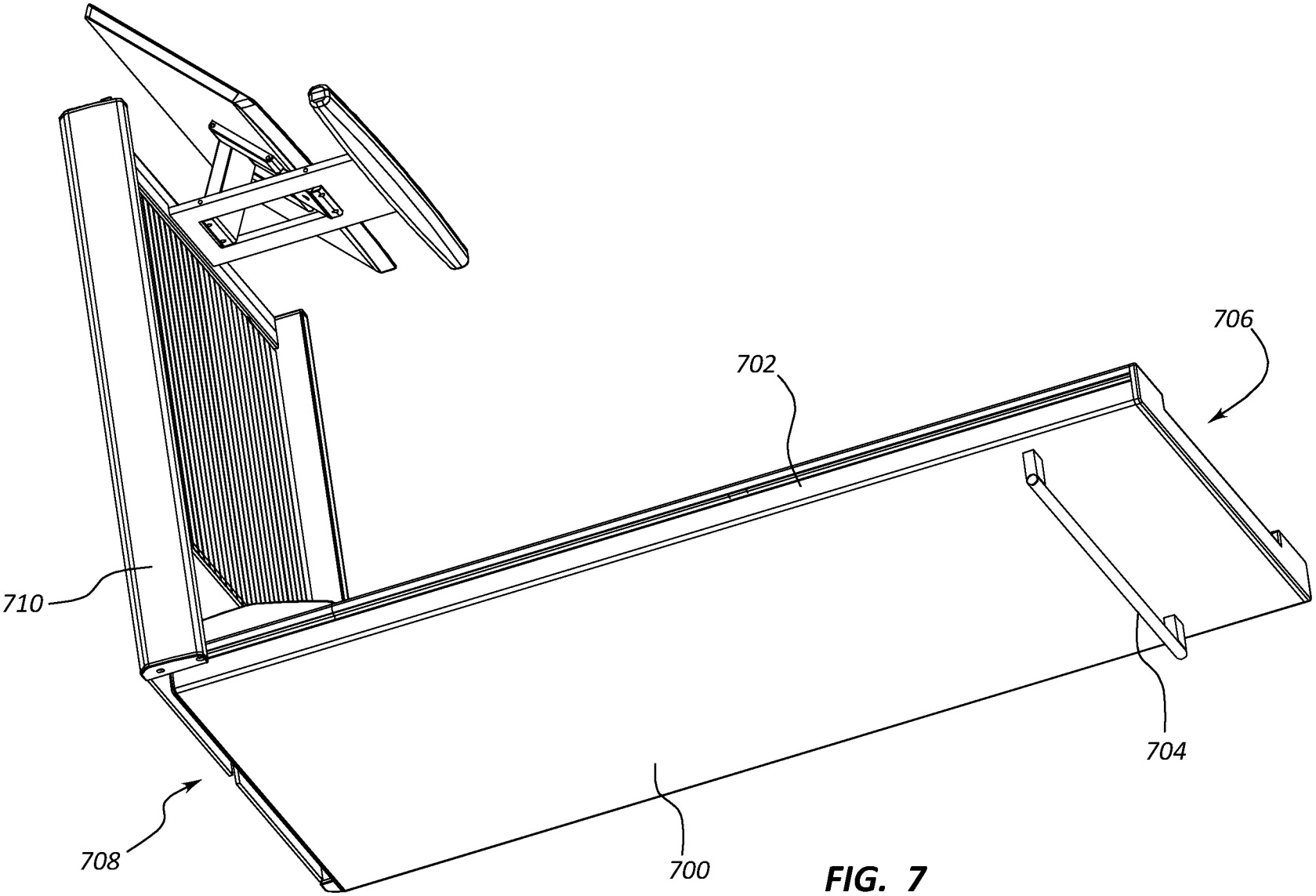
FIG. 7 depicts an example of a wall mountable apparatus in accordance with aspects of the present disclosure.

FIG. 7 depicts an example of an underside 700 of the treadmill deck 702. In this example, a support leg 704 is connected to the underside 700 proximate the far region 706 of the treadmill deck 702. The attached region 708 of the treadmill deck 702 is pivotally connected to the wall mountable bracket 710.

Figure 8:
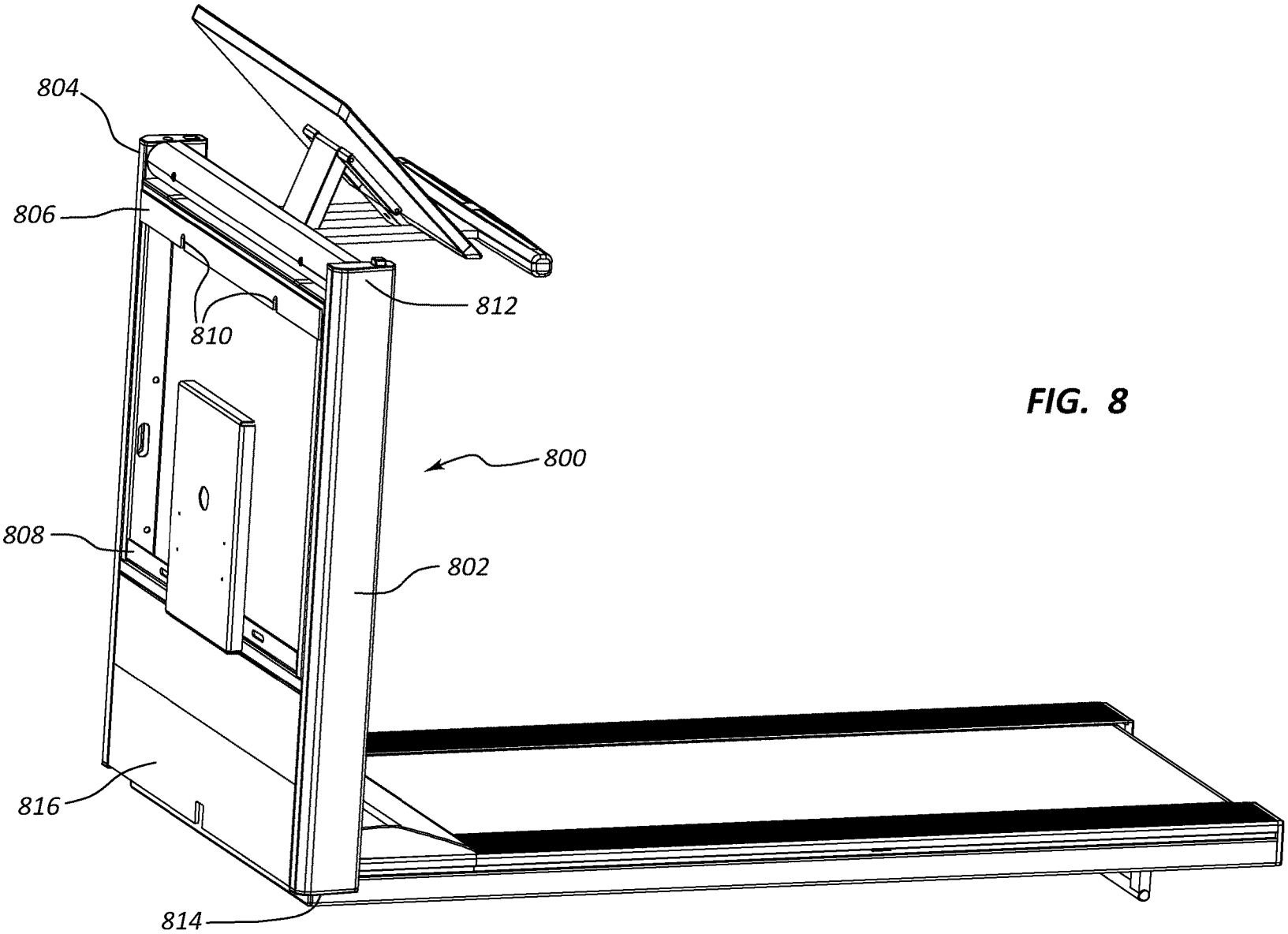
FIG. 8 depicts an example of a wall mountable apparatus in accordance with aspects of the present disclosure.

FIG. 8 depicts an example of the wall mountable bracket 800. The wall mountable bracket 800 may include a first side wall 802 and a second side wall 804 that is spaced apart from the first side wall at a distance. A top cross member 806 connects the first side wall 802 and the second side wall 804. A lower cross member 808 is aligned with the top cross member 806 and is spaced apart from the top cross member 806 at a distance. The lower cross member 808 also connects the first side wall 802 and the second side wall 804.

In the illustrated example, the top cross member 806 and the bottom cross member 808 include fastener openings 810 defined there through. Fasteners (not shown) can be inserted through these openings 810 to mount the wall mountable bracket 800 against a wall.

In FIG. 8, the top cross member 806 and the lower cross member 808 are not spaced apart at the same distance as the bracket length of the first and second side walls 802, 804. In this example, the top cross member 806 is located at a distance away from the top 812 of the side walls 802, 804. Likewise, the lower cross member 808 is located at a distance away from the bottom 814 of the side walls 802, 804.

A panel 816 may fill the space between the first side wall 802 and the second side wall 804. Such a panel may be located in front of the top and lower cross members 806, 808. In other examples, these panels may be located above and/or below at least one of the top and lower cross members 806, 808.

Figure 9:
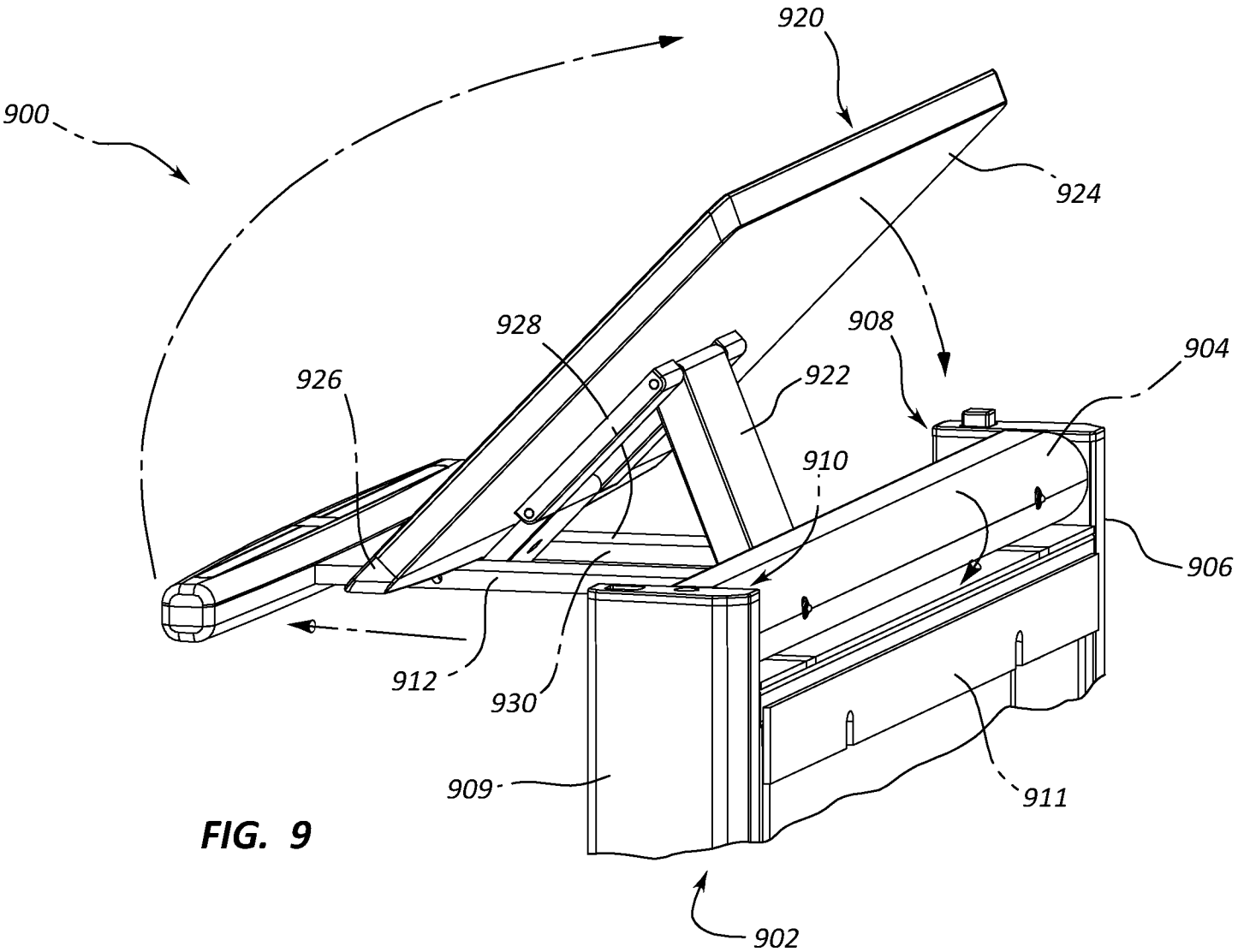
FIG. 9 depicts an example of a support structure in accordance with aspects of the present disclosure.

FIG. 9 depicts an example of a support structure 900 connected to the wall mountable bracket 902. In this example, the support structure 900 includes a pivot beam 904 that connects to the first side wall 906 at a first support end 908 and connects to a second side wall 909 at a second support end 910. The pivot beam 904 may be located above the top cross member 911 that connects the first and second side walls 906, 909.

The pivot beam 904 is connected to a cantilever 912 of the support structure 900. The arm support 914 is connected to a distal end 916 of the cantilever 912. The arm support 914 may include at least one handle 918 that is sized and spaced for a convenient grip for a user when the treadmill deck is in an operational position. In some examples, at least one input mechanism is incorporated into the handle 918.

A display 920 is integrated into the support structure 900. A brace 922 is depicted propping up the backside 924 of the display 920. The brace 922 is pivotally connected to the cantilever 912 at one end and pivotally connected to the backside 924 of the display 920 on the other end. An edge 926 of the display 920 is engaged with a top side 928 of the cantilever 912. The engagement with the edge 926 and the brace 922 collectively position the display 920 at an angle for viewing. The engagement between the display's edge 926 and the cantilever's top side 928 may be facilitated through a recess defined in the top side 928 of the cantilever 912 that is aligned with the edge 926. In another example, a surface on either the cantilever or the edge that produces sufficient friction may be used to cause the engagement. In yet another example, the edge may include a Velcro surface that assists with causing the engagement.

The edge 926 may be disengaged from the top side 928 of the cantilever 912, which frees the display 920 to be positioned at a different angle or to be laid down flat on the top side 928 of the cantilever 912. An opening 930 is defined in the top side 928 of the cantilever 912, which can guide a feature of the display when repositioning the angle of the display 920. In some examples, a feature located in the opening 930 may be used to cause engage the edge 926. For example, a recess may be formed in the opening 930 that interlocks with a feature of the display 920 to prevent the display 920 from sliding with respect to the cantilever 912.

When transitioning the display 920 from the operational position to the storage position, the edge 926 may be disengaged and slid forward towards the arm support 914. The brace 922 may pivot downward toward/into the opening 930 until the display 920 is substantially flat/aligned with the cantilever. With the display 920 up against the cantilever, the support structure 900 may be rotated about the pivot beam 904 into an upright storage position.

Figure 10:
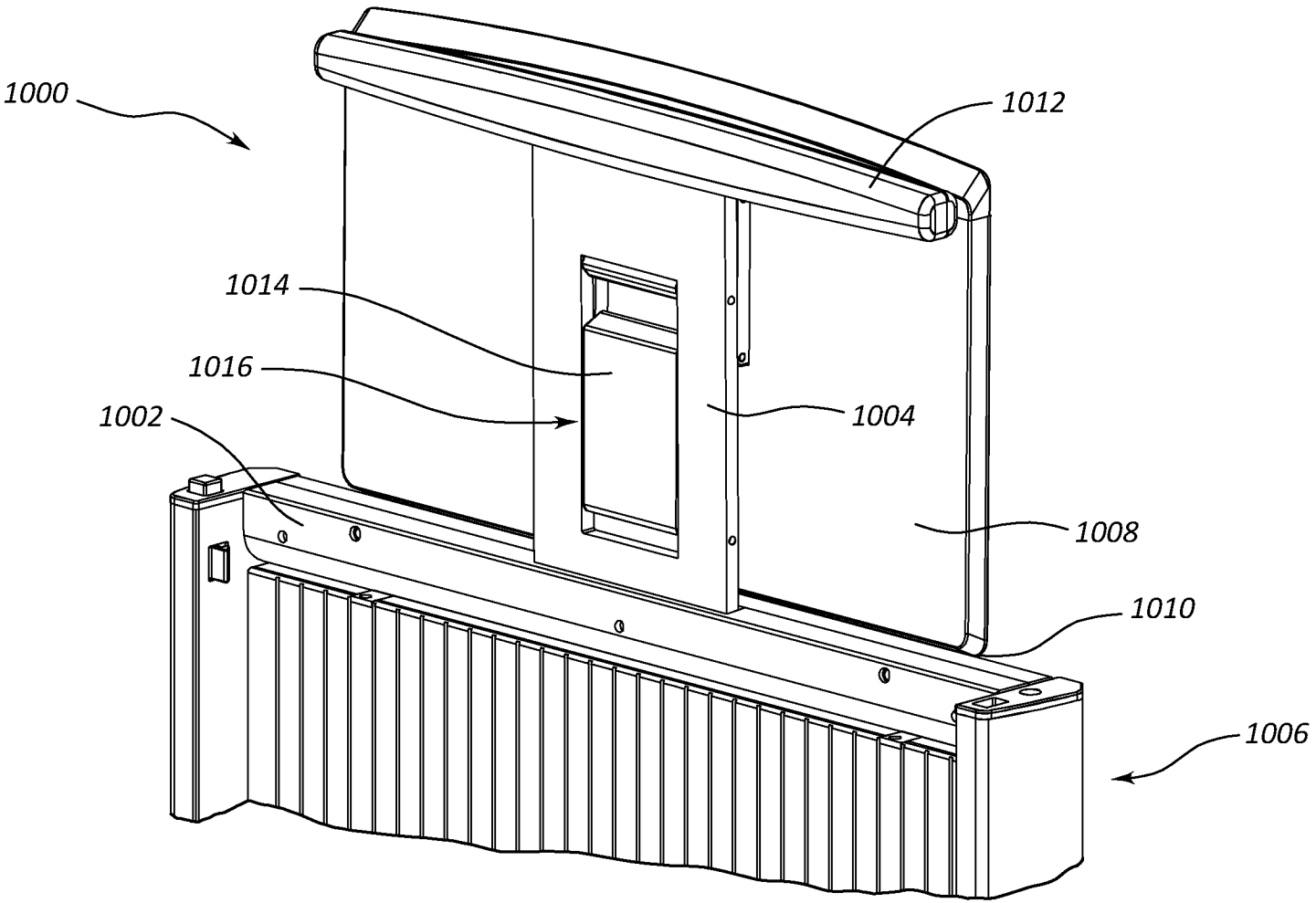
FIG. 10 depicts an example of a support structure in accordance with aspects of the present disclosure.

FIG. 10 depicts an example of the support structure 1000 in the storage position. In this example, the pivot beam 1002 is oriented to cause the cantilever 1004 to be aligned with the length of the wall mountable bracket 1006. The display 1008 is slid forward so that the display's edge 1010 is flush with the handles 1012. The brace 1014 is located in the opening 1016 defined in the cantilever 1004. With the support structure in the storage position, the treadmill deck may be raised into the storage position.

Figure 11:
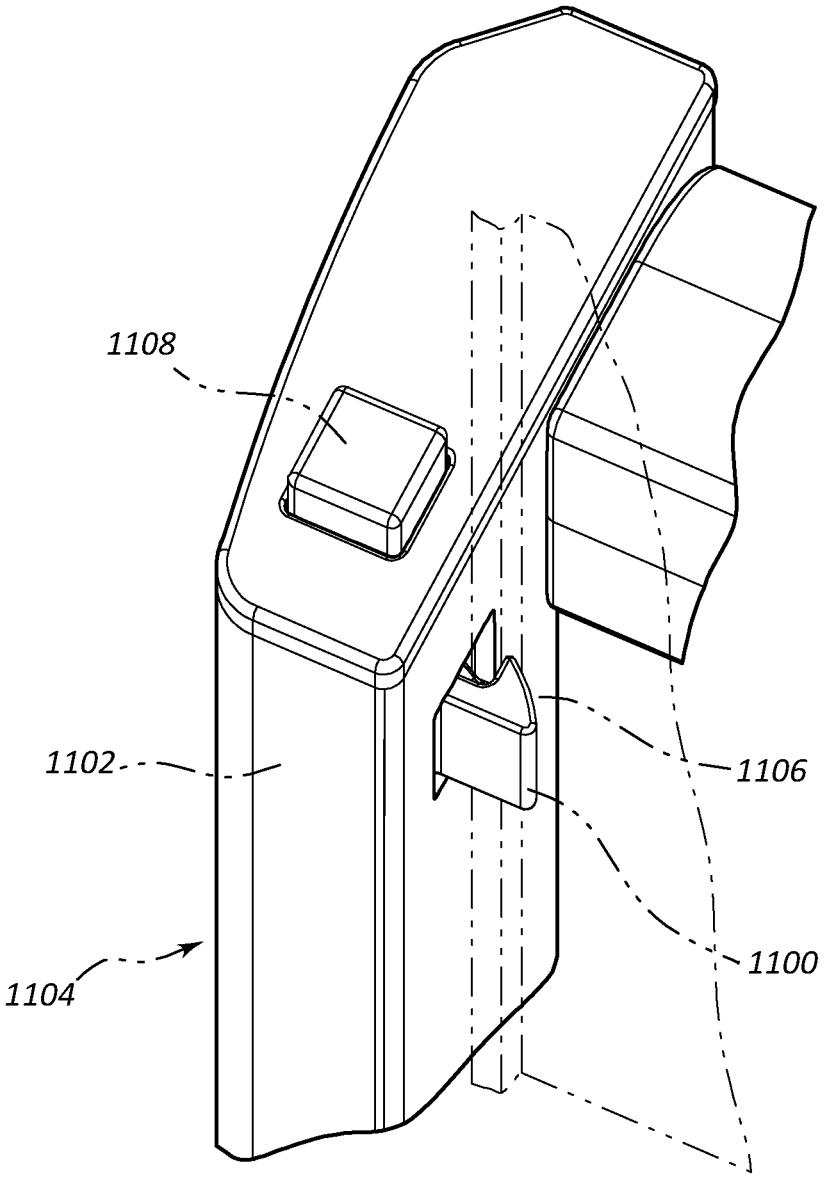
FIG. 11 depicts an example of latching system in accordance with aspects of the present disclosure.

FIG. 11 depicts an example of a mechanism for maintaining the treadmill deck in the storage position. In this example, a latch 1100 is incorporated into an inside of a side wall 1102 of the wall mountable bracket 1104.

The latch 1100 includes a curved surface 1106 that is shaped to deflect the latch 1100 to the side when the latch 1100 engages the treadmill deck. A release button 1108 may be used to cause the latch 1100 to move thereby releasing the treadmill deck from the storage position.

Figure 12:
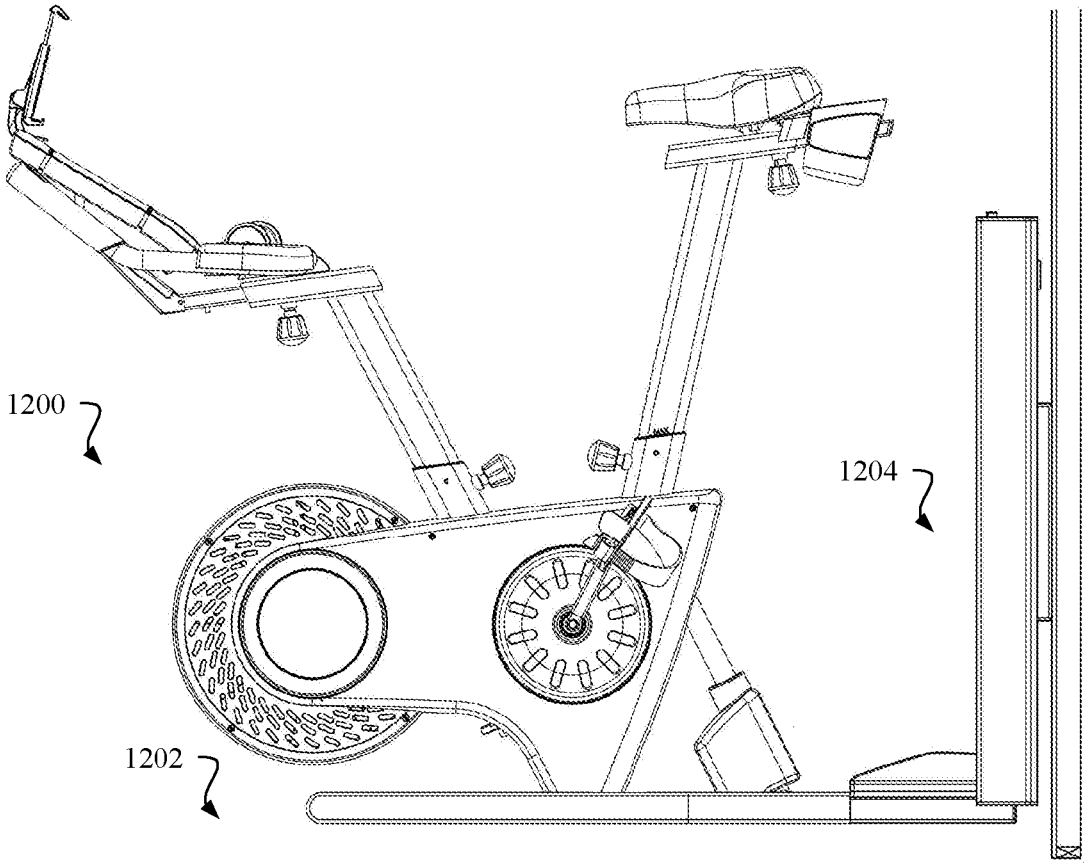
FIG. 12 depicts an example of a wall mountable apparatus incorporating an exercise bike in accordance with aspects of the present disclosure.
Figure 13:
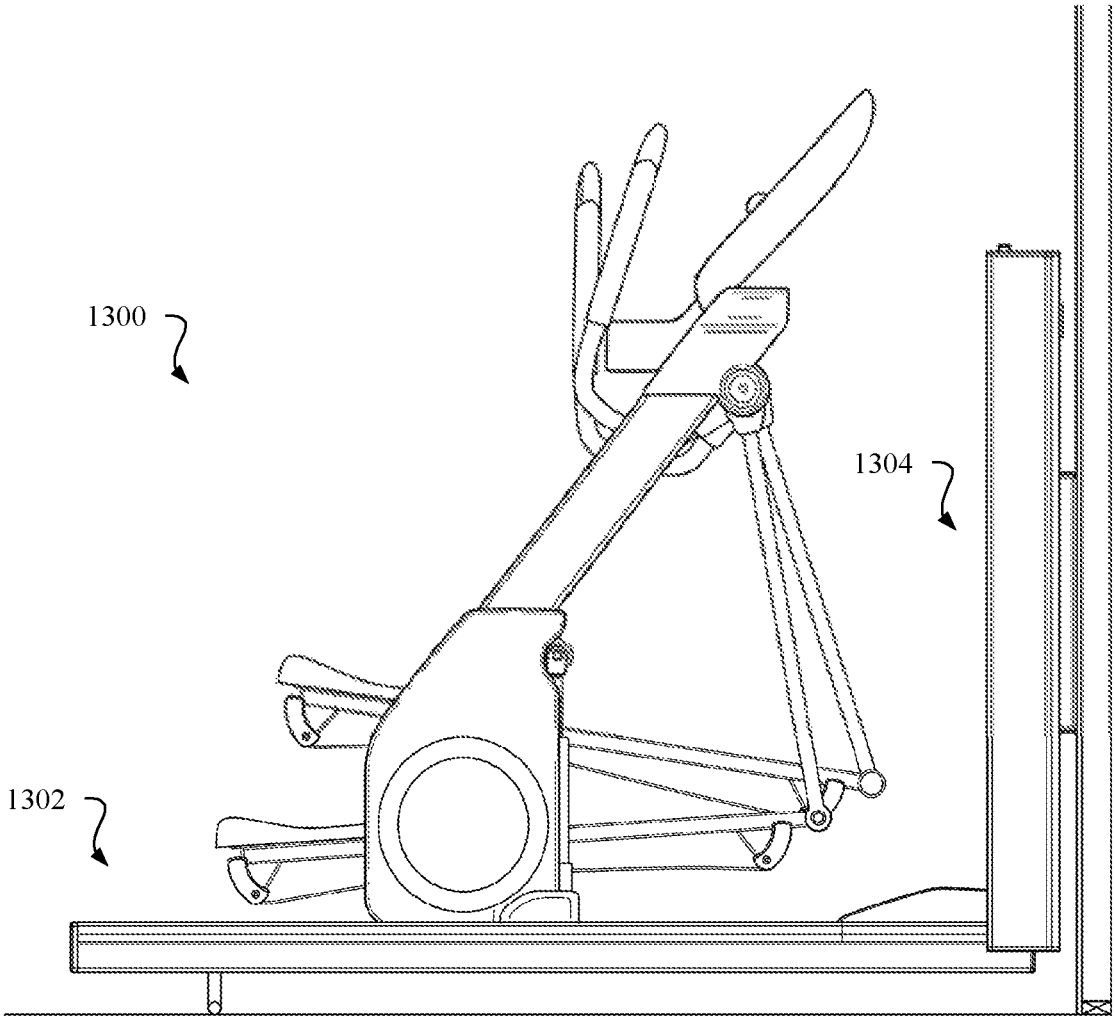
FIG. 13 depicts an example of a wall mountable apparatus incorporating an elliptical trainer in accordance with aspects of the present disclosure.

FIGS. 12-13 depict examples of certain exercise machines with an inclinable portion connected to a stationary frame. FIG. 12 depicts an example of an exercise bike 1200 that includes a platform 1202 that is inclinable with respect to a stationary wall mountable bracket 1204. As the platform 1202 is inclined with respect to the stationary wall mountable bracket 1204, the exercise bike 1200 is also inclined. Similarly, FIG. 13 depicts an example of an elliptical trainer 1300 includes a platform 1302 that is inclinable with respect to a stationary wall mountable bracket 1304. As the platform 1302 is inclined with respect to the stationary wall mountable bracket 1304, the elliptical trainer 1300 is also inclined.

Figure 14:
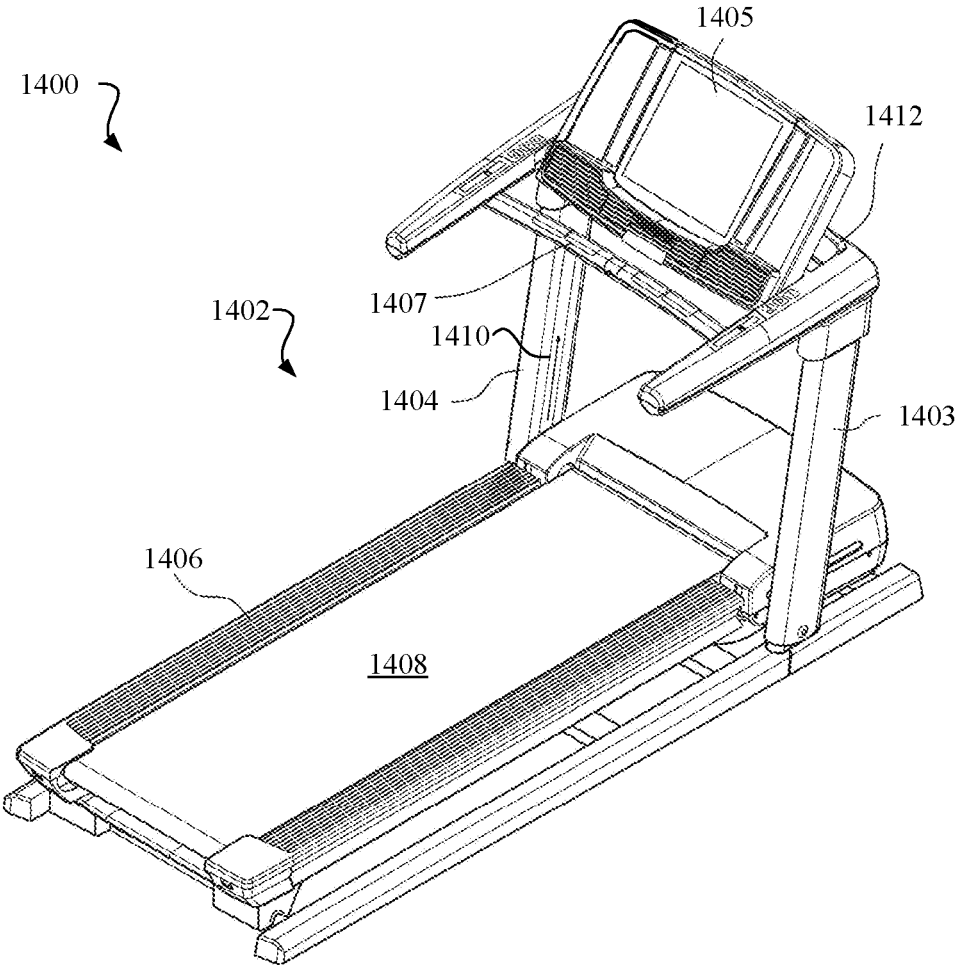
FIG. 14 depicts an example of an exercise machine with an inclinable portion and a stationary frame in accordance with aspects of the present disclosure.

FIG. 14 depicts an example of a treadmill 1400. The stationary frame 1402 of the treadmill 1400 includes a first upright post 1404 and a second upright post 1404. A bridge 1412 connects the first upright post 1404 to the second upright post 1403. In this example, a console 1405 and a control bar 1407 are supported by the first and second upright posts 1404, 1403. An inclinable portion 1406 of the treadmill 1400 includes a tread belt 1408 that moves with respect to the inclinable portion 1406 when pulleys incorporated within the inclinable portion 1406 rotate.

The inclinable portion 1406 includes a pivot bar that extends out beyond the width of the inclinable portion 1406 and resides, in part, within a track 1410 that is defined in the length of the first and second upright posts 1404, 1403. A coiling mechanism and a motor that drives the coiling mechanism may be incorporated in at least one of the first upright post 1404 and the second upright post 1403. The flexible coiling link may connect the coiling mechanism to the pivot rod incorporated into the attached region of the inclinable portion 1406. As the coiling mechanism winds up the flexible coiling link, the attached region of the inclinable portion 1406 may be elevated to increase the incline angle of the inclinable portion 1406 and therefore the platform that incorporated the tread belt 1408. As the coiling mechanism unwinds the flexible coiling link, the inclinable portion 1406 may be lowered, decreasing the incline of the inclinable portion 1406.

Figure 15:
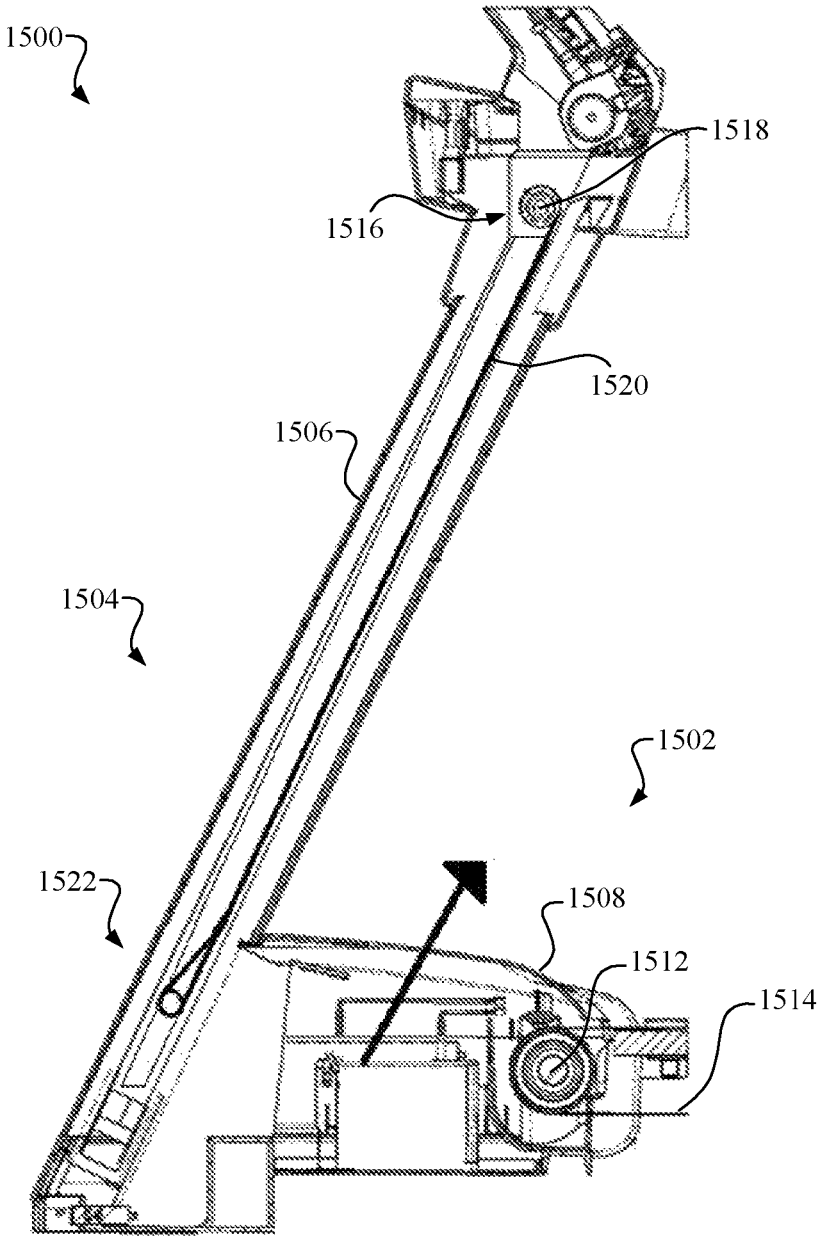
FIG. 15 depicts a cross sectional view of an example of an exercise machine with an inclinable portion and a stationary frame in accordance with aspects of the present disclosure.

FIG. 15 depicts an example of a treadmill 1500 with an inclinable portion 1502 that includes a slideable attachment 1504 to at least one stationary upright post 1506 of the treadmill 1500. In this example, the inclinable portion 1502 includes a motor housing 1508 connected to the attached region of the inclinable portion 1502. A motor causes the pulley 1512 depicted in the example of FIG. 15 to move and is located in the motor housing 1508. As the pulley 1512 rotates, the tread belt 1514 is caused to move thereby providing a moving surface on which a user can exercise.

In this example, the coiling mechanism 1516 is located inside a hollow portion of the stationary upright post 1506. The coiling mechanism 1516 may include a coiling rod 1518 connected to a coiling motor (not shown for illustrative purposes) that turns the coiling rod 1518 in a first direction to wind up the flexible coiling link 1520 or in a second direction, opposite to the first direction, to unwind the flexible coiling link 1520. In this example, a portion of the flexible coiling link 1520 is connected to the coiling mechanism 1516, and a far end 1522 of the flexible coiling link 1520 is connected to slideable attachment 1504 of the inclinable portion 1502 of the treadmill 1500. As the coiling motor rotates in the first or second direction, the slideable attachment is moved accordingly thereby lowering or raising the elevation of the attached end of the inclinable portion 1502.

In alternative examples, the motor housing and therefore the belt's motor, may be located on the far end (not shown) of the inclinable portion away from the stationary upright posts. In this example, the weight of the belt's motor is kept lower to the ground when the inclinable portion's incline angle increases and may contribute to stabilizing the treadmill by keeping the center of gravity closer to the ground. Further, by placing the belt's motor at the far end of the inclinable portion, the coiling motor may have a smaller load to move when adjusting the height of the inclinable portion's attached end.

Figure 16:
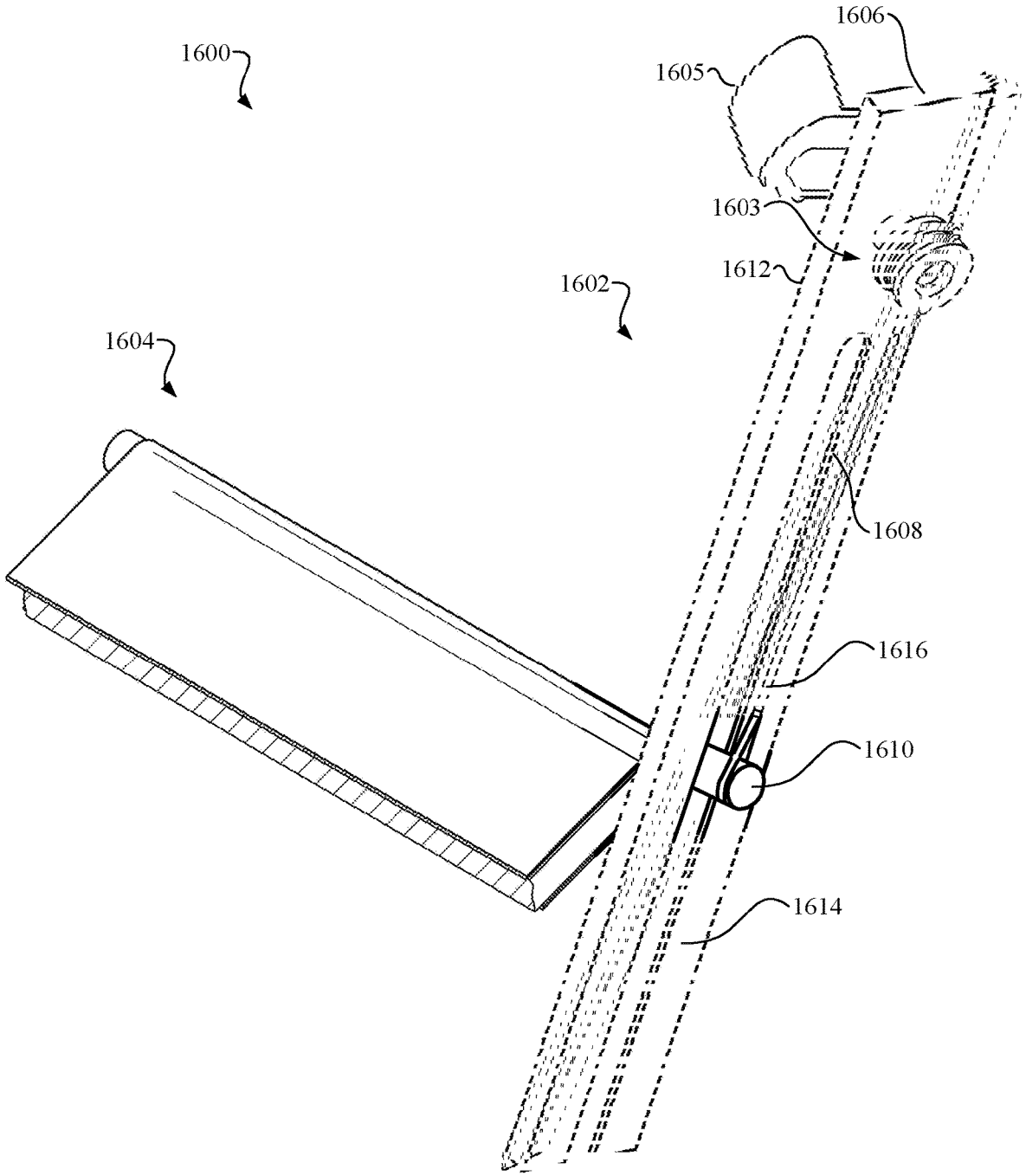
FIG. 16 depicts an example of a coiling mechanism connected to an inclinable portion and connected to a stationary frame in accordance with aspects of the present disclosure.

FIG. 16 depicts an example of the movable attachment 1600 between the stationary frame 1602 and the inclinable portion 1604 of a treadmill. In this example, the stationary frame 1602 includes an upright post 1606 that is free standing such that the upright post 1606 is independent of a wall or another structure. A slot 1608 is defined in the upright post 1606 into which a protruding member 1610 of the inclinable portion is partially disposed. The protruding member 1610 is connected to the flexible coiling link and may move as the flexible coiling link 1616 moves. A motor 1605 may be connected to the coiling mechanism 1603 that causes the coiling mechanism to wind up or unwind the flexible coiling link 1616.

In the depicted example, the slot 1608 is a through slot and connects a first side 1612 of the upright post 1606 to a second side 1614 of the upright post 1606. In this example, the protruding member 1610 spans the thickness of the upright post 1606, and the protruding member is connected to the flexible coiling link 1616 adjacent to the second side 1614 of the upright post. The sides of the slot 1608 confine the movement of the protruding member 1610 to just moving along the length of the slot 1608. In some cases, the upright post may include a hollow portion, and the slot connects the first side of the slot to an inside surface of the hollow portion. In such an example, the flexible coiling link may be at least partially disposed within the hollow portion.

In an alternative example, the slot does not extend through the entire thickness of the upright post. In one such example where the slot does not extend through the entire thickness of the upright post, the slot may be a recess defined in the upright post of a recess defined in a component that is attached to the upright post. The recess may also confine the movement of the protruding member to be along the length of the upright post.

In some examples, the coiling mechanism is on the first side of the upright post, and the coiling mechanism is stationary with the upright post. In this example, the upright post may include a slot, a recess, or another type of guide, or combinations thereof to guide the movement of the protruding member. However, in other examples, the upright post does not include features that guide the movement of the protruding member.

Figure 17:
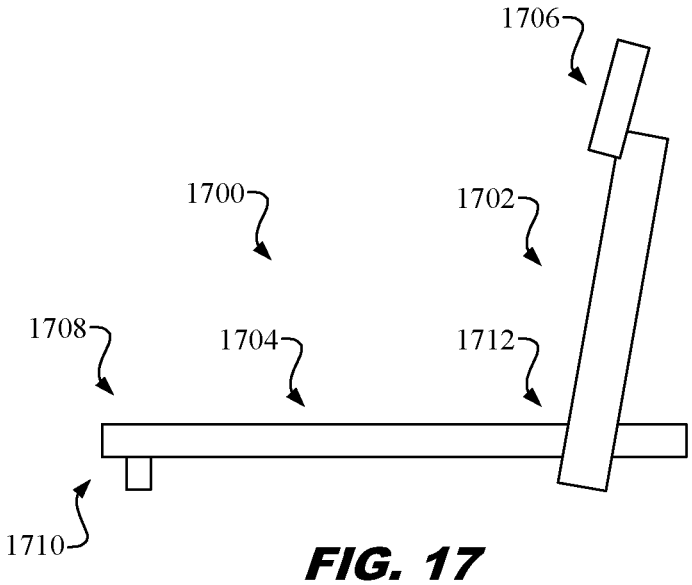
FIG. 17 depicts an example an inclinable portion in an uninclined operating orientation in accordance with aspects of the present disclosure.
Figure 18:
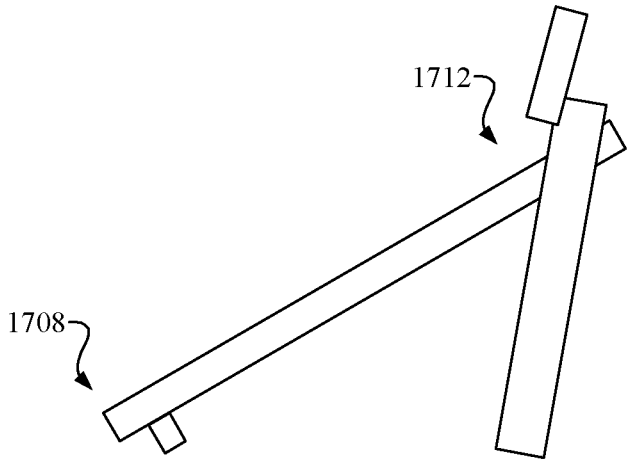
FIG. 18 depicts an example an inclinable portion in an inclined operating orientation in accordance with aspects of the present disclosure.
Figure 19:
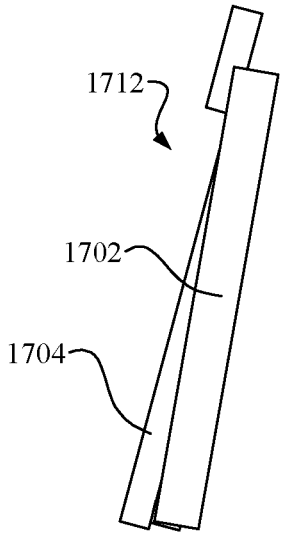
FIG. 19 depicts an example an inclinable portion in a storage orientation in accordance with aspects of the present disclosure.

FIGS. 17-19 depict examples of a treadmill 1700 with a stationary frame 1702 and an inclinable portion 1704. In this example, the treadmill includes a console 1706, but in other examples, the treadmill 1700 may be without a console. In each of these examples, the stationary frame 1702 may be free standing such that the stationary frame 1702 does not rely on a wall or other support structure independent of the treadmill to stay upright. In some cases, the stationary frame includes upright posts or other types of structural members of the treadmill. The inclinable portion 1704 may include a platform for a user to exercise, and a movable tread belt may be incorporated into the platform.

In the example of FIG. 17, the stationary frame 1702 is aligned with a support surface on which the treadmill resides. In some cases, a far region 1708 of the inclinable portion 1704 includes at least one leg 1710, and the weight of the far region 1708 is supported with the leg 1710. In this example, the weight of an attached region 1712 of the inclinable portion 1704 is attached to the stationary frame 1702. But, in other examples, the attached region 1712 may include may be connected to an underside or a leg 1710 attached to the underside of the inclinable portion 1704.

While the example of FIG. 17 depicts the inclinable portion at uninclined, operational orientation. In this example, the attached region 1712 is at the same elevation as the far region 1708. In some cases, the inclinable portion may be declined so that the attached region 1712 has a lower elevation than the far region 1708.

FIG. 18 depicts an example of the attached region 1712 in an inclined, operational orientation. In this orientation, the attached region 1712 is elevated above the height of the far region 1708. In some cases, the inclinable portion 1704 may be inclined to any appropriate incline angle. For example, the incline angle is greater than 5 degrees, greater than 10 degrees, greater than 15 degrees, greater than 25 degrees, greater than 35 degrees, greater than 45 degrees, greater than another appropriate degree, or combinations thereof. In some cases, the inclinable range is between 0 degrees and 125 degrees. In other examples, the inclinable range may be between 0 degrees and 90 degrees. However, any appropriate inclinable range may be used in accordance with the principles of the present disclosure.

FIG. 19 depicts an example of the attached region 1712 is inclined into a storage orientation. In this example, the attached region 1712 is moved up along the length of the stationary frame 1702 so that the angle of the inclinable portion 1704 is aligned with the angle of the stationary frame 1702.

Figure 20:
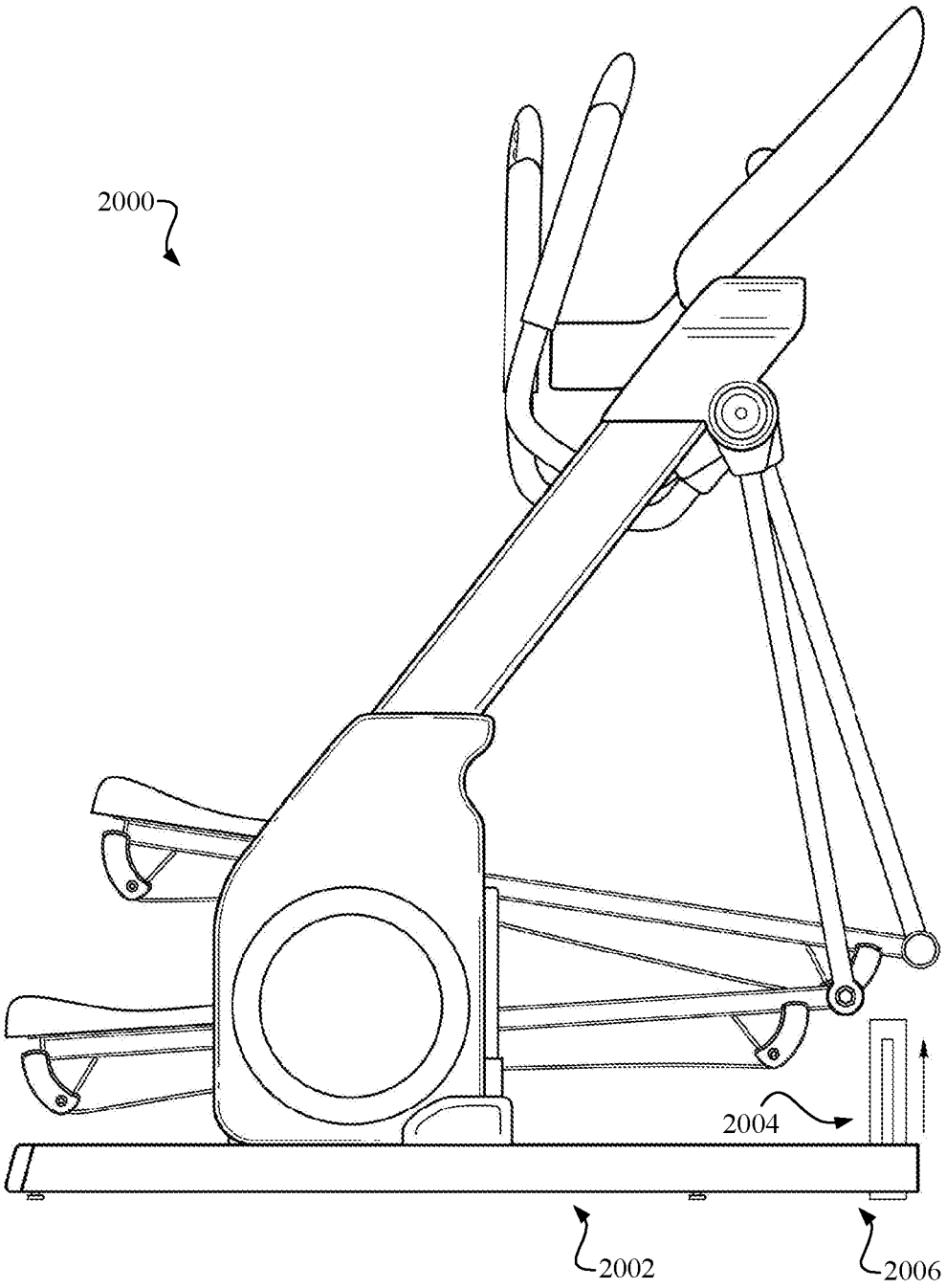
FIG. 20 depicts an example of an elliptical exercise machine with an inclinable portion and a stationary frame in accordance with aspects of the present disclosure.

FIG. 20 depicts an example of an elliptical exercise trainer 2000 connected to an inclinable portion 2002, such as a base frame member. The inclinable portion 2002 is connected to a stationary frame 2004. In this example, the stationary frame 2004 is free standing, and includes a coiling mechanism and a flexible coiling link and can lift the attached region 2006 of the inclinable portion 2002 to incline the inclinable portion 2002 at a desired incline angle.

Figure 21:
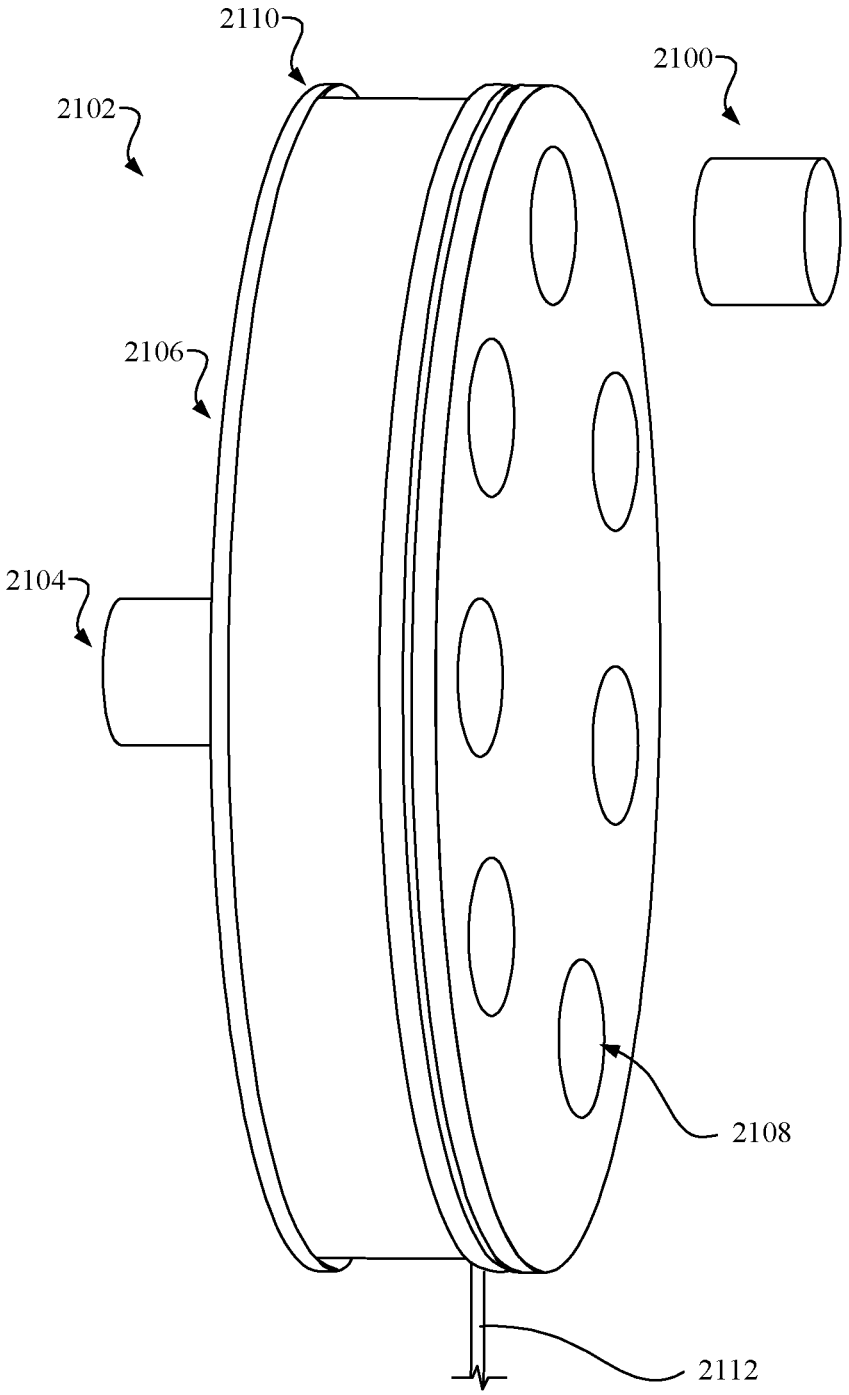
FIG. 21 depicts an example of a sensor incorporated into a coiling mechanism in accordance with aspects of the present disclosure.

FIG. 21 an example of a sensor 2100 incorporated into a coiling mechanism 2102. In this example, the coiling mechanism 2102 includes a coiling rod 2104, a coiling reel 2106, at least one identifiable unit 2108 incorporated into the coiling reel 2106, and a sensor 2100 that counts as the identifiable units 2108 move pass the sensor when the reel rotates about an axis of the coiling rod 2104. The coiling reel 2106 includes a lip 2110 on the edge of the coiling reel 2106 to prevent the flexible coiling link 2112 from slipping off the coiling reel 2106.

The sensor 2100 can count as each of the identifiable units 2108 pass. Any appropriate type of sensor may be used. For example, the sensor may be a magnetic sensor, an optical sensor, a tactile sensor, a camera, a cam follower, another type of sensor, or combinations thereof. For example, if the identifiable units are magnetized, the magnetic sensor may sense the identifiable units as the they pass. In some examples, the identifiable units 2108 may include different magnetic strengths, which can assist the sensor 2100 in identifying what sequence the identifiable units 2108 are passing the sensor. The sensor 2100 may use this sequence to determine the direction that the coiling reel 2106 is rotating. In another example, the identifiable units 2108 may be reflective units, and the sensor may emit a light that is reflected back by the identifiable units 2018 to the sensor 2100 to determine when the identifiable units 2108 are passing the sensor 2100. The identifiable units 2108 may include different reflective signatures that may assist in determining the sequence/direction that the identifiable units 2108 are moving.

In other examples, the motor may output a signal that indicates which direction that the motor is rotating the coiling rod 2104. The motor's signal may be used to determine the direction that the coiling reel 2106 is rotating. In yet another example, a user interface may also send a signal that indicates the direction that the user is requesting that the inclinable portion to be moved.

Counting the times that the identifiable units 2108 pass provides an input that can be used to determine the incline angle of the inclinable portion. For example, in those examples where the identifiable units 2108 are equally spaced, the passing of each identifiable unit 2108 may indicate a direct proportional distance that the attached region of the inclinable portion has moved. This distance may be used to determine the incline angle of the inclinable portion.

Any appropriate number of identifiable units 2108 may be incorporated into the coiling reel 2106. In some examples, a single identifiable unit 2108 may be incorporated into the coiling reel 2106. In yet another example, the coiling reel 2106 may include 2 to 50 identifiable units 2108. Generally, the more equally spaced identifiable units 2108 incorporated in to the coiling reel 2106, the higher precision in determining the incline angle.

While this example depicts the identifiable units 2108 incorporated into a side face of the coiling reel 2106, the identifiable units 2108 may be incorporated into the circumference of the coiling reel 2106, into the lip 2110 of the coiling reel 2106, into the coiling rod 2104, into another portion of the coiling mechanism 2102, or combinations thereof.

Figure 22:
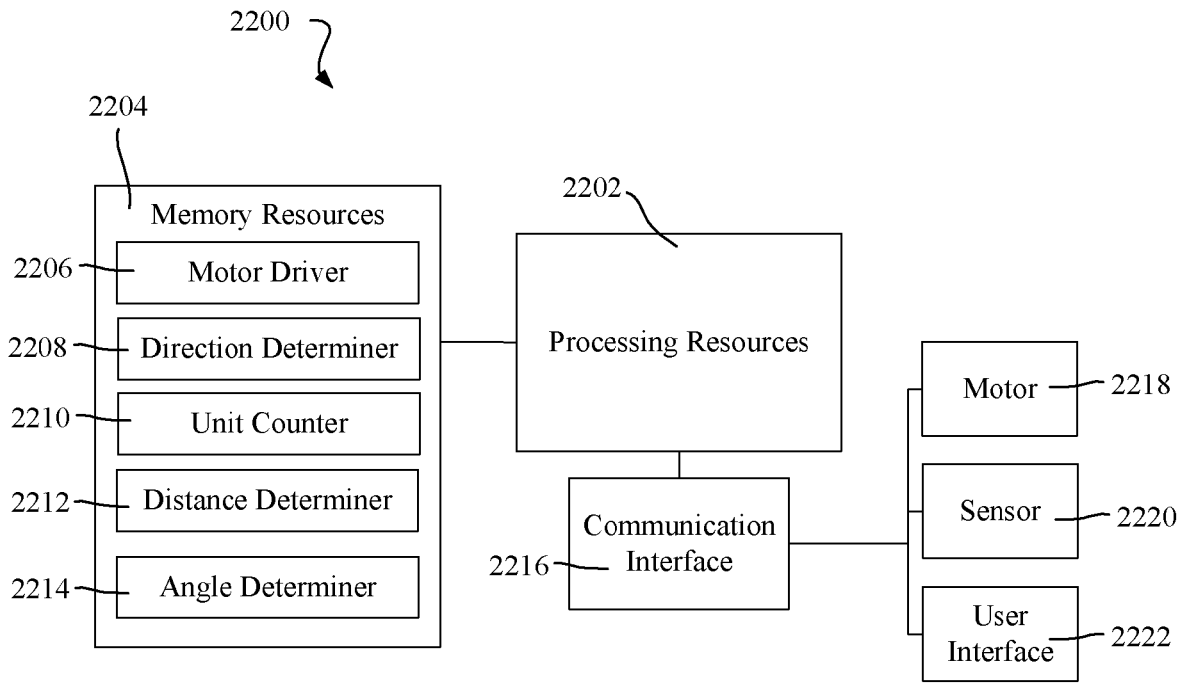
FIG. 22 depicts a block diagram of an example of a system for determining an incline of an inclinable portion of an exercise machine in accordance with aspects of the present disclosure.

FIG. 22 illustrates a perspective view of an example of a system 2200 in accordance with the present disclosure. The system 2200 may include a combination of hardware and programmed instructions for executing the functions of the system 2200. In this example, the system 2200 includes processing resources 2202 that are in communication with memory resources 2204. Processing resources 2202 include at least one processor and other resources used to process the programmed instructions. The memory resources 2204 represent generally any memory capable of storing data such as programmed instructions or data structures used by the system 2200. The programmed instructions and data structures shown stored in the memory resources 2204 include motor driver 2206, a direction determiner 2208, a unit counter 2210, a distance determiner 2212, and an angle determiner 2214.

The processing resources 2202 may be in communication with communications interface 2216 that communicates with external devices. Such external devices may include a motor 2218, a sensor 2220, a user interface 2222, or combinations thereof. In some examples, the processing resources 2202 communicate with the external devices through a mobile device which wirelessly relays communications between the processing resources 2202 and the remote devices or through inputs incorporated into the console of the exercise machine.

The motor driver 2206 represents programmed instructions that, when executed, cause the processing resources 2202 to cause the motor to rotate. The direction determine represents programmed instructions that, when executed, cause the processing resources 2202 to determine the direction that the motor is causing the inclinable portion to move. The unit counter 2210 represents programmed instructions that, when executed, cause the processing resources 2202 to count the number of units that pass by the sensor. The distance determiner 2212 represents programmed instructions that, when executed, cause the processing resources 2202 to determine the distance that the flexible coiling link has moved. In some examples, the distance determiner may multiply the unit count by a predetermined value to determine the distance that the flexible coiling link has moved. The angle determiner 2214 represents programmed instructions that, when executed, cause the processing resources 2202 to determine the angle of the inclinable portion. In some examples, the location of the attached region of the inclinable portion is associated with an incline angle with stored in a look up chart that can be referenced by the angle determiner.

GENERAL DESCRIPTION

In general, the invention disclosed herein may provide users with an exercise machine with an incline mechanism that can adjust the incline angle of an inclinable portion of the exercise machine. The exercise machine may include an inclinable portion and a stationary frame that is connected to the inclinable portion through a flexible coiling link. A coiling mechanism may wind up the flexible coiling link, which increases the incline angle, or the coiling mechanism may unwind the flexible coiling link to decrease the incline angle. Such an incline mechanism may provide a strong, reliable, and robust incline mechanism.

The stationary frame may include an upright post, multiple upright posts, a wall mountable bracket, or another type of stationary frame. In those examples with the wall mountable bracket, the wall mountable bracket may connect the inclinable portion to the wall. For example, the wall mountable bracket may connect an inclinable treadmill deck to the wall. Thus, the wall provides additional stability to the treadmill deck as the user exercises. A portion of the treadmill deck's weight (as well as the user's weight when the user is on the treadmill deck) is supported by the wall as the wall mountable bracket holds the attached region of the treadmill deck off the ground. Another advantage of the wall mountable bracket is that the vibrations generated in the treadmill deck may be reduced due to the stability provided by the wall's support.

The leg support and the wall mountable bracket may collectively support the weight of the deck and the weight of the user. A support leg may be attached to the any appropriate location of the deck. In some examples, the support leg is attached to the deck's underside at a rear end of the treadmill deck. In other examples, the support leg is attached to a mid-section of the treadmill deck allowing at least a portion of the deck's rear end to cantilever out above the support surface. In other examples, multiple support legs may be placed along the length of the treadmill deck for additional stability. One advantage to having a leg support and the wall mountable bracket hold the entire treadmill deck off the ground when in a substantially horizontal orientation is improved mechanical loading of the deck when the deck is placed at an incline. For example, when the attached region of the deck is elevated, a greater proportion of the deck's weight is transferred along the length of the deck and into the underlying support surface through the support leg. This may be an additional benefit over examples that do not incorporate support legs where the treadmill deck may need additional reinforcement if the embodiments allows for inclining the deck.

The wall mountable bracket may be made of any appropriate material that is strong enough to support the weight of the treadmill deck in both the operational orientation and the storage orientation. The user may also mount the wall mountable bracket at any location that is desirable to the user. In contrast, the wall mountable bracket provides an additional advantage that the treadmill is not confined to a specific location in a building due to needing to be placed in proximity to an opening in the wall or in proximity to other types of equipment.

In some examples, the exercise machine includes a wall mountable bracket and a treadmill deck connected to the wall mountable bracket. An attached region of the treadmill deck may be connected to a lower portion of the wall mountable bracket and may include a pivot mechanism. In this type of example, the pivot mechanism can include a pivot rod with a first side that is connected to a first side wall of the wall mountable bracket and a second side that is connected to a second side wall of the wall mountable bracket.

The treadmill deck may be sized to fit within the space defined by the first side wall and the second side wall of the wall mountable bracket. The treadmill deck can rotate about the pivot mechanism and nest within the space defined by the bracket when the exercise machine is in a storage orientation. A support leg may be connected to an underside of the treadmill deck. The support leg and the wall bracket collectively support the weight of the treadmill deck. In one example, the support leg is connected to the treadmill's underside at a far region of the treadmill deck, which is opposite the attached region of the deck.

The deck may include a first pulley located in an attached region of the deck and a second pulley located in a far region of the deck. A tread belt may surround the first and second pulleys and provide a surface on which the user may exercise. At least one of the first pulley and the second pulley may be connected to a drive motor so that when the drive motor is active, the pulley rotates. As the pulley rotates, the tread belt moves as well. The user may exercise by walking, running, or cycling on the tread belt's moving surface.

Any appropriate trigger may be used to cause the coiling motor to change the deck's incline angle. In some cases, the incline angle is changed in response to an input from the user, a simulated environment, a programmed workout, a remote device, another type of device or program, or combinations thereof.

The wall bracket and the leg support may collectively maintain the treadmill deck off the support surface. The treadmill deck may be spaced away from and apart from the support surface (e.g. the floor) at any appropriate distance. In some examples, the distance that the treadmill is spaced away from the support surface when the treadmill is maintained at a level orientation is less than one inch, less than six inches, less than a foot, less than two feet, another appropriate distance, or combinations thereof.

In some examples, at least one of the first pulley and/or second pulley is in mechanical communication with the drive motor. When the drive motor is active, the drive motor causes the pulley to rotate, which causes the tread belt to move. In one example, the treadmill deck is caused to move so that a top portion of the tread belt rotates away from the wall mountable bracket and a bottom portion of the tread belt rotates towards the wall mountable bracket. A flywheel may be attached to and coaxial with the drive motor so that the flywheel rotates with the drive motor.

Any appropriate type of drive motor may be used to drive the tread belt in a rotational direction. In some examples, the drive motor may be an alternating current motor that draws power from an alternating power source, such as the power circuit of a building. In some cases, the drive motor is a direct current motor. In some of the examples with a direct current motor, the direct current motor draws power from a building power circuit, but the alternating current is converted to direct current.

A flywheel may be connected to a portion of the drive motor so that the flywheel rotates when the drive motor is active. The flywheel may store rotational energy and assist with moving the tread belt at a consistent speed. In some examples, the flywheel has a common rotational axis with the drive motor. In these examples, the flywheel may be connected to the drive motor with an axle. In other situations, the flywheel is attached directly to a side of the drive motor. The flywheel may include any appropriate size, shape, length, width, and weight in accordance with the principles described herein.

To reduce the weight of the treadmill, and therefore the load on the wall mountable bracket and the wall, the treadmill deck may be manufactured to be thinner than conventional treadmill decks. In some cases, the pulleys, drive motor, flywheel, other components involved with the tread belt are also thinner than conventional. To provide sufficient power, but to also maintain a thin profile of the treadmill deck, multiple motors may be used. In other examples, just a single motor is used to drive the movement of the pulleys and tread belt.

The flywheel incorporated into the thin deck may have a diameter that is shorter than conventional flywheels. In flywheels, the rotary energy that is stored during the rotation of the flywheel is in the flywheel's outer circumference, which motivates one of ordinary skill in the art to increase the flywheel's circumference to store more energy while reducing the flywheel's cross-sectional thickness. Thus, the flywheel's outer diameter is greater than the flywheel's axial length. In contrast, the flywheel may include an axial length that is greater than its outer diameter. In this example, the flywheel includes a rotational axis, a flywheel length aligned with the rotational axis, an outer diameter transverse the flywheel length where the flywheel length is greater than the outer diameter.

In some cases, the length of the flywheel is at least three inches. In another example, the length of the flywheel is at least four inches. In additional examples, the length of the flywheel is at least five inches. In yet another example, the length of the flywheel is at least six inches. In an even additional example, the length of the flywheel is at least seven inches.

The flywheel may be supported with a support connected to the deck on a first side of the flywheel and on a second side of the flywheel. In other examples, either of the flywheel's ends may be supported by other components that are at least fixed with respect to the treadmill deck. A bearing assembly may be used on each end of the flywheel to support the flywheel from sagging.

Any appropriate type of fan assembly may be used in accordance with the principles described in the present disclosure. In one example, the fan assembly includes a ring member that defines a central annulus. The ring member may include a fan face and an attachment face opposite of the fan face. The attachment face may connect to the flywheel, and a fan blade may be formed on the fan face. In some examples, the fan blade includes a geometry that forces air to move in response to the rotation of the ring element. In some cases, the fan blades are protrusions that extend beyond the fan face. These blades may include any appropriate type of shape including, but not limited to, a generally rectangular shape, a generally crescent shape, a generally square shape, another general shape, or combinations thereof. In some cases, the blade generates lift, which causes the high and low-pressure regions of the air in the immediate vicinity of the blade as the ring element rotates.

In some cases, the ring element includes a lip that protrudes from the fan face's edge and extends away from the fan face in the same direction as the fan blade extends from the fan face. The lip may extend away from the fan face at the same distance as the fan blades. In some cases, the circumferential lip may extend away from the fan face at a greater distance than the fan blade. In yet other examples, the fan blades may extend from the fan face at a greater distance than the lip extends. The lip may contribute to directing the airflow generated by the fan assembly.

In some examples, a low-pressure region is generated within the annulus of the ring element when the fan assembly rotates. As a result, air is pulled into the annulus. In those examples where the ring member is attached to the side of the flywheel, the flywheel blocks air from traveling through the annulus which focuses the airflow to the side. The shape of the fan blades may also direct the airflow to the side. The air that is directed to the ring member's side is forced forward of the fan face as the air moves towards the lip attached to the ring's circumferential edge. The lip blocks the air from flowing directly off the ring element's side. Thus, the airflow that is pulled towards the annulus of the ring member is rerouted to move in an opposing direction. In some cases, the airflow is rerouted 180 degrees. In some examples, the airflow is rerouted between 120 degrees to 175 degrees. The redirected airflow may be contained within the housing. As the redirected airflow travels off the fan face at an angle, the airflow may generate low pressure regions behind the fan assembly. These low-pressure regions may cause air to flow within other regions within the housing.

In one example, the wall mountable bracket includes a first side wall and a second side wall that is spaced apart from the first side wall at a distance. A top cross member connects the first side wall and the second side wall. A lower cross member aligns with the top cross member and is spaced apart from the top cross member at a distance. The lower cross member also connects the first side wall and the second side wall. The top cross member and the bottom cross member include fastener openings. Fasteners can be inserted through these openings to mount the wall mountable bracket against a wall. In other examples, fastener openings may be incorporated into other portions of the wall mountable bracket to connect the bracket to the wall.

In some cases, the top cross member and the lower cross member may not be spaced apart at the same distance as the bracket length of the first and second side wall. In this case, the top cross member may be located at a distance away from the top of the side walls, and the lower cross member may be located at a distance away from the bottom of the side walls. A panel may fill the space between the first side wall and the second side wall. Such a panel may be located in front of the top and lower cross members. In other examples, these panels may be located above and/or below at least one of the top and lower cross members.

Any appropriate mechanism for maintaining the treadmill deck in the storage position may be used. In some cases, a latch is incorporated into an inside of a side wall of the wall mountable bracket. The latch may include a curved surface that is shaped to deflect the latch to the side when the latch engages the treadmill deck. A release button, also incorporated into the wall mountable bracket, may be used to cause the latch to move to release the treadmill deck from the storage position.

The wall mountable bracket may define a nestable region in which the treadmill deck may reside when in the storage position. In one example, the first side wall and the second side wall define at least a portion of the nestable region. In some cases, the nestable region is also defined with a top cross member. But, in many examples, the top cross member is incorporated into a back portion of the nestable region, thereby leaving the top portion of the nestable region open. In those examples where the length of the treadmill is longer than the wall mountable bracket, just a portion of the treadmill deck may reside in the wall mountable bracket when the deck is in the storage position.

The treadmill deck may be in the storage position when the deck is aligned with the wall mountable bracket and is held close enough to the wall mountable bracket in a vertical orientation to minimize the amount of the treadmill deck that protrudes away from the wall mountable bracket. In the operational position, the treadmill deck is transversely oriented so that the deck protrudes out and away from the wall mountable bracket. In this orientation, the treadmill deck may be held in a horizontal position that is aligned with the support surface. In the operational orientation, the treadmill deck may be held in a substantially horizontal orientation or the treadmill deck may be held at an inclined orientation as desired by the user for a workout.

The treadmill deck may be moved into the storage position through incline mechanism. For example, the incline mechanism may cause the attached region of the treadmill deck to be raised high enough that the deck's incline angle is aligned with the length of the wall mountable bracket. The incline mechanism may be used to transition the treadmill deck between the operation orientations and the storage orientations. In some examples, the incline mechanism may replace a need for the user to manually assist with transiting the deck into or out of the storage position.

In alternative examples, the user can move the treadmill deck from the storage position to the operational position or vice versa manually. In this example, the user may lift the far region of the treadmill deck from off the support surface. As the far region of the deck is raised, the attached region of the treadmill deck may rotate about a pivot mechanism. In this example, the attached region of the treadmill deck may remain in the general region where the attached region of the treadmill deck resided in the operational position during the deck lifting process. As the far region of the treadmill deck approaches the wall mountable bracket, the latch may engage the treadmill deck to secure the deck in the storage position.

Any appropriate pivot mechanism may be used in accordance with the principles described in the present disclosure. In some cases, the pivot mechanism includes a pivot rod with a first side of the pivot rod interconnected with the first side wall of the wall mountable bracket, and a second side of the pivot rod interconnected with the first side wall of the wall mountable bracket. The pivot rod may be incorporated into the attached region of the treadmill deck.

In alternative examples, a first independent pivot rod may be incorporated into a first side of the deck that is interlocked with the first side of the wall mountable bracket, and a second independent pivot rod may be incorporated into a second side of the deck that is interlocked with the second side of the wall mountable bracket. The attached region of the deck may rotate about these independent pivots. Other types of mechanisms may be used in accordance with the principles described herein.

The attached region of the treadmill deck may be connected to the wall mountable bracket through one or more shocks. A pair of shocks may include a first shock connected to a first side of the wall mountable bracket and a second shock connected to a second side of the wall mountable bracket. The first and second shocks may connect to the attached region of the treadmill deck. In some examples, the shocks are gas springs or another appropriate type of shock.

A gas spring may be a type of spring that uses a compressed gas contained in a cylinder and compressed by a piston. In some cases, the gas spring includes a cylinder that is pressurized with nitrogen gas, which can store energy when compressed. The gas spring also includes a piston mounted on a rod that can slide back and forth inside a cylinder. When the piston rod is moved into the cylinder, the piston compresses the gas exerting a pressure to push the piston rod back in the opposite direction, But, a gas spring also allows the gas to flow through or around the piston from one side to the other as it moves back and forward. Thus, the piston rod moves, but the flow of the gas around the piston causes the gas spring to move slowly, thereby causing the rod to move slowly as well. In examples where the shocks include a gas spring, the piston rod can be attached to either the wall mountable bracket or to the deck. The cylinder of the gas spring may be connected to either the wall mountable bracket or to the deck depending on what the piston rod is connected to. Thus, as the user exerts a variable amount of force on the treadmill deck from running or performing another type of exercise on the treadmill deck, the gas spring can insulate the wall mountable bracket from the associated vibrations.

Any appropriate type of gas spring may be used. For example, a non-exhaustive list of gas spring types that may be compatible with the principles described herein may include a standard cylinder, a fixed-height cylinder, a spindle, a cable cylinder, a stage cylinder, a non-rotating cylinder, a return cylinder, an auto-return cylinder with height adjustment, a bouncing cylinder, a dual-mode cylinder, another type of cylinder, or combinations thereof. Other types of shocks may be used other than gas springs. In some examples, metal tension springs, metal compression springs, elastomeric materials, spacers, rubber, other types of shocks, or combinations thereof may be used.

The attached region of the treadmill deck may hang from the shocks. In this example, the shocks may be configured to primarily resist the vibrations of the treadmill deck through tensile forces. In another example, the shocks may be located between the underside of the treadmill deck and a portion of the wall mountable bracket. In this example, the shocks may be configured to primarily resist the vibrations of the treadmill deck through compressive forces.

The treadmill deck may also be inclined so that the attached region of the deck is at a higher elevation than the far region. In this example, an incline mechanism includes a first slot incorporated into the first side wall and a second slot incorporated into the inside of the second side wall. The first and second slots may be aligned with one another to define an incline path that the attached region of the treadmill deck may follow when the attached region of the treadmill deck is moved upwards to form an incline angle.

In one example, a first slot is defined in a first side wall and aligned with a length of the wall mountable bracket, and a second slot is defined in a second side wall and aligned with the length of the wall mountable bracket. A first region of the pivot rod may be disposed within the first slot, and a second region of the pivot rod may be disposed within the second slot. The attached region of the treadmill deck may be movable along an incline path defined by the first slot and the second slot, and the incline angle of the treadmill deck may be changed when the attached region moves along the incline path.

In some cases, a user may manually adjust the incline of the deck by raising the attached region of the deck. In other examples, the incline mechanism may be automated so that the user does not have to lift the attached region of the deck to adjust the incline angle.

In one example, the incline mechanism is incorporated into the first side wall and the second side wall of the wall mountable bracket. A pivot rod supports the attached region of the treadmill deck, and a flexible coiling link, such as a strap, supports the pivot rod. A fixed side of the strap is rigidly connected to the wall mountable bracket, and a coil side of the strap is connected to the coiling rod of a coiling mechanism. In this example, the coiling mechanism includes a motor that causes the coiling rod to rotate. As the motor rotates in a first direction, the strap shortens lifting the deck's attached region. When the coiling rod is caused to rotate in a second direction, which is opposite the first direction, the strap unwinds off the coiling rod allowing the deck's attached region to lower. In some cases, the motor maintains the position of the strap and thereby maintains the incline angle.

In other examples, a thread screw may be used to raise and lower the attached region of the deck to change the deck's incline angle. In this example, the thread screw may also maintain the incline angle. In some cases, the attached region of the deck is guided with the slots defined in the wall mountable bracket, but in other examples, the wall mountable bracket does not include guide slots.

In some cases, a locking mechanism may be incorporated into the deck and/or the wall mountable bracket to maintain the treadmill deck once the deck is orientated at the desired incline angle. In some cases, the locking mechanism includes at least one insertable pin that can be used to hold the deck in position.

In some cases, at least some of the components of the wall mountable bracket may move with the attached region of the deck. For example, the shocks may move with the attached region of the deck and be repositioned to prevent vibrations at the elevated location where the deck contacts the wall mountable bracket.

In some examples, the deck can be inclined to any appropriate incline. For example, the incline angle may be greater than 5 degrees, greater than 10 degrees, greater than 15 degrees, greater than 20 degrees, greater than 25 degrees, greater than 35 degrees, at 45 degrees, at another degree, or combinations thereof.

In some examples, the wall mountable bracket includes a display. A display support structure may connect the wall mountable bracket to the display. The display support structure may space the electronic display at a distance apart from the wall mountable bracket when the display is in an operational position, and the display support structure may position the electronic display up against the wall mountable bracket when the electronic display is in a storage position.

In some examples, the display is a touch screen, which can include controls for controlling various features of the treadmill deck, provide entertainment during the workout, and/or provide instructions for executing the workout.

In one example, the support structure includes a pivot beam that connects to the first side wall at a first support end and connects to a second side wall at a second support end. The pivot beam may be located above the top cross member that connects the first and second side walls. The pivot beam may be connected to a cantilever of the support structure. The arm support may be connected to a distal end of the cantilever. The arm support may include at least one handle that is sized and spaced for a convenient grip for a user when the treadmill deck is in an operational position. In some examples, at least one input mechanism is incorporated into the handle.

The display may be integrated into the support structure. A brace may prop up the backside of the display when the display is in the operational position. The brace may be pivotally connected to the cantilever at one end and pivotally connected to the backside of the display on the other end. An edge of the display may be engaged with a top side of the cantilever. The engagement with the edge and the brace may collectively position the display at an angle for viewing. The engagement between the display's edge and the cantilever's top side may be facilitated through a recess defined in the top side of the cantilever that is aligned with the edge. In another example, a surface on either the cantilever or the edge that produces sufficient friction may be used to cause the engagement. In yet another example, the edge may include a Velcro surface that assists with causing the engagement.

The edge may be disengaged from the top side of the cantilever, which frees the display to be repositioned at a different angle or to be laid down flat on the top side of the cantilever. An opening is defined in the top side of the cantilever, which can guide a feature of the display when repositioning the angle of the display. In some examples, a feature located in the opening may be used to cause the edge to engage the cantilever. For example, a recess may be formed in the opening that interlocks with a feature of the display to prevent the display from sliding with respect to the cantilever.

When transitioning the display from the operational position to the storage position, the edge may be disengaged and slid forward towards the arm support. The brace may pivot downward toward/into the opening until the display is substantially flat/aligned with the cantilever. With the display up against the cantilever, the support structure may be rotated about the pivot beam into an upright storage position.

The display may be located within a convenient reach of the user to control the operating parameters of the deck when the deck is in the operational position. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real-world route. For example, the user may input instructions through the display, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real-time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the attached region of the running deck. Likewise, if the beginning of the simulated route is on a downward slope, the far region of the running deck may be caused to elevate to simulate the decline in the route. Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

An arm support may also be connected to the wall mountable bracket. In some cases, the arm support is also connected to the cantilever that supports the display. When in an operational position, the arm support may be transversely oriented with respect to a bracket length of the wall mountable bracket; and when in a storage position, the arm support may be aligned with respect to the length of the wall mountable bracket.

In some cases, the display and/or arm supports may be adjustable vertically to accommodate for users of different heights. In this example, the support structure may be movable along a track that is located on the inside surfaces of the wall mountable brackets.

In another example, the deck may be inclinable to a negative degree. In one of these types of examples, the support legs may be extendable so that the far region of the deck can elevate to a higher position than where the deck's attached region is attached wall mountable bracket. In another example, the wall mountable bracket may move the attached region of the deck to a lower position than the height of the support leg.

While the examples above have been described with reference to a wall mountable treadmill as the exercise machine, the incline mechanism may be incorporated into any appropriate exercise machine. For example, the exercise machine may be a treadmill, an elliptical trainer, a skiing simulating exercise machine, a rowing machine, a cable machine, stationary bike, another type of machine, or combinations thereof. Further, the stationary frame may be a free-standing structure of the exercise machine that is not connected to the wall or another type of structure. As an example, the stationary frame may be at least one upright post. The components of the coiling mechanism may be incorporated into the stationary frame, next to the stationary frame, or combinations thereof. In some cases, at least one of the coiling motor, the coiling rod, the coiling reel, the flexible coiling link, another coiling mechanism component, or combinations thereof are attached to the stationary frame, reside within a hollow portion of the stationary frame, or combinations thereof.

The attached region of the inclinable portion may be guided along the length of the upright posts with a slot defined in the upright posts. In some cases, the attached region is guided in a through slot, a recess, a component connected to the upright posts, or combinations thereof.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. An exercise machine, comprising:

a stationary frame;

an inclinable portion movably connected at a front end to the stationary frame;

a shock absorber connected to the stationary frame and the inclinable portion at the front end of the inclinable portion, the shock absorber being configured to reduce vibrations on the inclinable portion; and an incline mechanism connected to the stationary frame, the incline mechanism including:

a coiling mechanism;

a coiling rod of the coiling mechanism;

a flexible coiling link movable with a rotation of the coiling rod; and wherein the flexible coiling link is connected to the inclinable portion.

2. The exercise machine of claim 1, further including:

a fixed end of the flexible coiling link attached to the stationary frame;

a coiled end of the flexible coiling link attached to the coiling mechanism;

wherein the flexible coiling link is connected to the inclinable portion between the fixed end and the coiled end.

3. The exercise machine of claim 2, wherein when the coiling mechanism rotates in a first direction, the flexible coiling link shortens thereby lifting an attached region of the inclinable portion;

wherein when the coiling rod is caused to rotate in a second direction, opposite of the first direction, the flexible coiling link unwinds off the coiling mechanism allowing the attached region of the inclinable portion to lower.

4. The exercise machine of claim 1, wherein the inclinable portion includes:

a pivot mechanism; and an attached region of the inclinable portion rotatable secured to the stationary frame through the pivot mechanism;

wherein a height of the pivot mechanism is adjustable through the incline mechanism.

5. The exercise machine of claim 4, further including:

a far region of the inclinable portion opposite the attached region;

wherein the height of the attached region of the inclinable portion is adjustable through the incline mechanism while a height of the far region is unadjustable through the incline mechanism.

6. The exercise machine of claim 1, wherein the inclinable portion further includes:

an underside of the inclinable portion; and at least one support leg connected to the underside;

wherein the stationary frame and the at least one support leg collectively space the underside off a support surface when the inclinable portion is in an operational orientation.

7. The exercise machine of claim 6, further including:

a far region of the inclinable portion that is opposite an attached region;

wherein the at least one support leg is proximate the far region.

8. The exercise machine of claim 1, wherein the stationary frame includes a wall mountable bracket.

9. The exercise machine of claim 1, wherein the stationary frame includes an upright post.

10. The exercise machine of claim 1, further including a console;

wherein the console is secured to the stationary frame.

11. The exercise machine of claim 1, wherein the inclinable portion includes at least one movable element that moves with respect to the inclinable portion during a performance of an exercise.

12. The exercise machine of claim 1, wherein the incline mechanism includes:

a first slot defined in and aligned with a length of the stationary frame;

a second slot defined in and aligned with the length of the stationary frame;

an attached region of the inclinable portion being connected to the first slot and the second slot;

wherein the attached region of the inclinable portion is movable along an incline path defined by the first slot and the second slot;

wherein an incline angle of the inclinable portion is changed when the attached region moves along the incline path.

13. The exercise machine of claim 1, wherein the inclinable portion includes an inclinable range through the incline mechanism between 0 degrees and 125 degrees.

14. The exercise machine of claim 1, further including:

a sensor incorporated into the coiling mechanism;

a processor and memory, the memory including programmed instructions, when executed, that causes the processor to:

determine an incline angle of the inclinable portion based on input from the sensor.

15. An exercise machine, comprising:

a stationary frame;

an inclinable portion movably connected at a front end to the stationary frame;

a shock absorber connected to the stationary frame and the inclinable portion at the front end of the inclinable portion, the shock absorber being configured to reduce vibrations at the inclinable portion; and an incline mechanism connected to the stationary frame, the incline mechanism including:

a coiling mechanism;

a coiling rod of the coiling mechanism;

a flexible coiling link movable with a rotation of the coiling rod;

a fixed end of the flexible coiling link attached to the stationary frame;

a coiled end of the flexible coiling link attached to the coiling mechanism;

wherein when the coiling mechanism rotates in a first direction, the flexible coiling link shortens thereby lifting an attached region of the inclinable portion;

wherein when the coiling rod is caused to rotate in a second direction, opposite of the first direction, the flexible coiling link unwinds off the coiling mechanism allowing the attached region of the inclinable portion to lower; and wherein the inclinable portion includes an inclinable range through the incline mechanism between 0 degrees and 125 degrees.

16. The exercise machine of claim 15, wherein the inclinable portion includes:

a pivot mechanism; and the attached region of the inclinable portion rotatably secured to the stationary frame through the pivot mechanism;

wherein a height of the pivot mechanism is adjustable by the incline mechanism.

17. The exercise machine of claim 16, further including:

a far region of the inclinable portion opposite the attached region;

wherein the height of the attached region of the inclinable portion is adjustable through the incline mechanism while a height of the far region is unadjustable through the incline mechanism.

18. The exercise machine of claim 15, further including:

a sensor incorporated into the coiling mechanism;

a processor and memory, the memory including programmed instructions, when executed, that causes the processor to:

determine an incline angle of the inclinable portion based on input from the sensor.

19. The exercise machine of claim 15, further including:

a first slot defined in and aligned with a length of the stationary frame;

a second slot defined in and aligned with the length of the stationary frame;

the attached region of the inclinable portion being connected to the first slot and the second slot;

wherein the attached region of the inclinable portion is movable along an incline path defined by the first slot and the second slot;

wherein an incline angle of the inclinable portion is changed when the attached region moves along the incline path.

20. An exercise machine, comprising:

a stationary frame;

an inclinable portion movably connected to the stationary frame;

a shock absorber connected to the stationary frame and the inclinable portion at a front end of the inclinable portion, the shock absorber being configured to reduce vibrations at the inclinable portion, wherein the shock absorber includes a first gas spring on a first side of the inclinable portion and a second gas spring on a second inclinable portion; and an incline mechanism connected to the stationary frame, the incline mechanism including:

a coiling mechanism;

a coiling rod of the coiling mechanism;

a flexible coiling link movable with a rotation of the coiling rod;

a fixed end of the flexible coiling link attached to the stationary frame;

a coiled end of the flexible coiling link attached to the coiling mechanism;

a sensor incorporated into the coiling mechanism;

a processor and memory, the memory including programmed instructions, when executed, that causes the processor to:

determine an incline angle of the inclinable portion based on input from the sensor;

the inclinable portion includes:

a pivot mechanism; and an attached region of the inclinable portion movably secured to the stationary frame through the pivot mechanism;

wherein a height of the pivot mechanism is adjustable by the incline mechanism;

wherein when the coiling mechanism rotates in a first direction, the flexible coiling link shortens thereby lifting the attached region of the inclinable portion;

wherein when the coiling rod is caused to rotate in a second direction, opposite of the first direction, the flexible coiling link unwinds off the coiling mechanism allowing the attached region of the inclinable portion to lower; and wherein the inclinable portion includes an inclinable range through the incline mechanism between 0 degrees and 125 degrees.

* * * * *